US012644302B2

(12) United States Patent
Davis et al.

(10) Patent No.: US 12,644,302 B2
(45) Date of Patent: Jun. 2, 2026

(54) STIFFENING APPARATUS

(71) Applicant: GRIPPLE LIMITED, Sheffield (GB)

(72) Inventors: Simon Davis, Sheffield (GB); Jacob Bennett, Sheffield (GB); Oliver Sunderland, Sheffield (GB)

(73) Assignee: GRIPPLE LIMITED (GB)

( * ) Notice: Subject to any disclaimer, the term of this patent is extended or adjusted under 35 U.S.C. 154(b) by 168 days.

(21) Appl. No.: 18/036,922

(22) PCT Filed: Nov. 29, 2021

(86) PCT No.: PCT/IB2021/061048
§ 371 (c)(1),
(2) Date: May 15, 2023

(87) PCT Pub. No.: WO2022/113031
PCT Pub. Date: Jun. 2, 2022

(65) Prior Publication Data

US 2024/0003155 A1 Jan. 4, 2024

(30) Foreign Application Priority Data

Nov. 30, 2020 (GB) ..... 2018793
Dec. 8, 2020 (GB) ..... 2019273
(Continued)

(51) Int. Cl.
*E04H 9/02* (2006.01)
*E04B 9/20* (2006.01)
(Continued)

(52) U.S. Cl.
CPC ..... *E04H 9/0237* (2020.05); *E04B 9/20* (2013.01); *E04B 1/92* (2013.01); *E04B 1/945* (2013.01); *E04B 1/98* (2013.01); *E04H 9/02* (2013.01)

(58) Field of Classification Search
None
See application file for complete search history.

(56) References Cited

U.S. PATENT DOCUMENTS 2,115,625 A * 4/1938 Fleshman ..... E04G 17/18 52/702
2,477,163 A * 7/1949 Barnett ..... F16B 9/052 403/205
(Continued)

FOREIGN PATENT DOCUMENTS

DE 29721485 U1 * 1/1998 ..... E04B 9/20
EP 3231954 B1 * 5/2021 ..... E04B 9/183
(Continued)

OTHER PUBLICATIONS

Office Action mailed on Sep. 24, 2025 for Japanese Patent Application No. 2023-532764.

*Primary Examiner* — Phi D A
(74) *Attorney, Agent, or Firm* — Clark Hill PLC; James R. Foley

(57) ABSTRACT

A stiffening apparatus (10) for use with a suspension assembly (12) is disclosed. The stiffening apparatus (10) comprises a suspension assembly (68) configured for receiving a first part of the suspension assembly (12). The stiffening apparatus (10) further includes a holder (70) extending transverse to the suspension assembly (68). The holder (70) is configured for receiving a second part of the suspension assembly (12). The holder (70) secures the stiffening apparatus (10) to the suspension assembly (12).

17 Claims, 23 Drawing Sheets

(30) Foreign Application Priority Data

Feb. 18, 2021 (GB) ..... 2102292
Nov. 26, 2021 (GB) ..... 2117075

(51) Int. Cl.
*E04B 1/92* (2006.01)
*E04B 1/94* (2006.01)
*E04B 1/98* (2006.01)

(56) References Cited

U.S. PATENT DOCUMENTS 2,846,732 A * 8/1958 Burns ..... E04B 1/2612 403/56
2,915,275 A * 12/1959 Korka ..... E04B 9/20 248/327
3,264,792 A * 8/1966 Drazdik ..... F24F 13/078 52/509
3,341,909 A * 9/1967 Havener ..... B25B 5/101 248/231.71
3,472,539 A 10/1969 Fenwick
4,739,602 A * 4/1988 Fricker ..... E04F 13/0855 52/235
4,744,191 A * 5/1988 Fricker ..... E04F 13/0855 52/235
4,856,252 A * 8/1989 Cornell ..... E04B 1/2612 249/23
5,039,039 A 8/1991 Schaffer
5,092,097 A * 3/1992 Young ..... E04B 1/2608 52/713
5,324,132 A * 6/1994 Hunter ..... E04B 1/2612 403/231
5,344,108 A 9/1994 Heath
6,026,545 A 2/2000 Duggan
6,298,623 B1 * 10/2001 Wendt ..... E04B 9/20 52/39
6,430,890 B1 * 8/2002 Chiwhane ..... E04C 3/02 52/715
6,607,086 B1 * 8/2003 Gretz ..... E04B 9/006 248/343
7,992,352 B2 * 8/2011 Bonds ..... E04B 1/08 52/712
8,096,518 B1 * 1/2012 Morgan ..... F16L 3/237 248/339
8,109,482 B2 * 2/2012 Oh ..... A62C 35/68 248/62
8,500,079 B2 * 8/2013 Oh ..... A62C 35/68 248/230.4
11,248,740 B2 * 2/2022 Witherbee ..... H02G 3/126
2006/0102820 A1 * 5/2006 Boville ..... F16B 2/245 248/300
2012/0160983 A1 6/2012 Gousseinov et al.
2013/0105641 A1 * 5/2013 Feenstra ..... E04B 9/18 248/75

FOREIGN PATENT DOCUMENTS

JP 2008014329 1/2008
JP 2015090199 5/2015
JP 2017020230 1/2017
KR 101791912 B1 11/2017
NL 2011004 C2 12/2014
WO 2016065039 A1 4/2016
WO 2019033477 A1 2/2019

* cited by examiner

STIFFENING APPARATUS

This application is a National Phase Filing of PCT/IB2021/061048, having an International filing date of Nov. 29, 2021, which claims priority of GB 2018793.6, filed Nov. 30, 2020, GB 2019273.8, filed Dec. 8, 2020, GB 2102292.6, filed Feb. 18, 2021 and GB 2117075.8, filed Nov. 26, 2021. The disclosure of the foregoing are hereby incorporated by reference.

This invention relates to stiffening apparatuses. More particularly, but not exclusively, this invention relates to stiffening apparatuses for stiffening suspension arrangements attached to overhead supports.

When suspended supports are installed in earthquake zones and other areas prone to seismic activity, it can be necessary to strengthen them. Cables, wire ropes or the like are mounted on the opposite ends of the suspended support and attached to the ceiling or roof to brace the track. Such stiffening is useful in the case of threaded rods.

However, where the supports are suspended by cables, wire rope or flexible elongate members, there is little ability to withstand compressive loads, for example in the case an uplift during seismic activity, is poor.

According to one aspect of this invention, there is provided a stiffening apparatus comprising a strut arrangement and a holder, the holder being provided on the strut arrangement, and the holder extending transverse to the strut arrangement, wherein the strut arrangement is configured to receive a first part of the suspension assembly, and the holder is configured to receive a second part of a suspension assembly.

According to another aspect of this invention, there is provided a stiffening apparatus for use with a suspension assembly, the stiffening apparatus comprising a strut arrangement configured for receiving a first part of the suspension assembly, and a holder extending transverse to the strut arrangement, the holder being configured for receiving a second part of the suspension assembly, and the holder being for securing the stiffening apparatus to the suspension assembly.

According to another aspect of the invention there is provided a stiffening apparatus to be used with a suspension assembly, the stiffening apparatus comprising a strut arrangement configured to receive a first part of the suspension assembly, and a holder extending transverse to the strut arrangement, the holder being configured to receive a second part of the suspension assembly, and the holder being configured to secure the stiffening apparatus to the suspension assembly.

The holder may be provided on the strut arrangement. The strut arrangement may be an upstanding strut arrangement.

According to another aspect of this invention, there is provided a stiffening apparatus comprising an upstanding strut arrangement and a holder, the holder being provided on the strut arrangement, and the holder extending transverse to the holder, wherein the holder comprises a securing element for securing the stiffening apparatus to a suspension assembly.

The holder may receive a part of the suspension assembly. The holder may be configured to receive the part of the suspension assembly.

According to another aspect of this invention, there is provided a stiffening apparatus comprising an upstanding strut arrangement and a holder, the holder being provided on the strut arrangement, wherein the stiffening apparatus further includes a securing element on the holder, the securing element being for securing the stiffening apparatus to a suspension assembly.

The holder may be configured to receive the second part of the suspension assembly.

The stiffening apparatus may comprise a main part. The main part may comprise the strut arrangement and the holder. The holder may extend transverse to the strut arrangement.

The holder may extend from the strut arrangement in one direction. The holder may extend forwardly of the strut arrangement.

The main part may be substantially L shaped. The strut arrangement and the holder may extend transverse to each other to provide the L shape. The strut arrangement and the holder may extend substantially perpendicular to each other.

The suspension assembly may comprise a suspension article and a support article. The support article may be attached to the suspension article.

The holder may be configured to receive the support article.

The support article may be elongate. The support article may comprise a channel support. The suspension article may be suspended from an upper support, such as a roof beam or a ceiling.

The suspension article may comprise an elongate member. The suspension article may be substantially flat. The suspension article may be a strap.

The strut arrangement may receive the suspension article. The holder may hold the support article.

The strut arrangement may hold the suspension article therein. The strut arrangement may have an open face. The open face of the strut arrangement may allow a part of the suspension assembly to be received in the strut arrangement. The open face of the strut arrangement may allow the suspension article to be received in the strut arrangement.

The open face of the strut arrangement may face in the direction in which the holder extends from the strut arrangement.

The strut arrangement may have opposite edges. The opposite edges of the strut arrangement may define the open face of the strut arrangement.

In the embodiment described herein, the open face of the strut arrangement may allow the stiffening apparatus to be fitted onto the suspension assembly after a load has been arranged on the support article.

The strut arrangement may have opposite proximal and distal ends, which may define openings. The suspension article may extend through the openings in the strut arrangement. The holder may be provided at the proximal end of the strut arrangement.

The strut arrangement may have a substantially U shaped end profile. The strut arrangement may have a substantially square end profile.

The strut arrangement may comprise a channel component. The strut arrangement may comprise a central member, which may be substantially flat. The strut arrangement may include lateral members extending from the central member. Each of the lateral members may be substantially flat.

Each lateral member may have a respective free edges. The free edges of the lateral members may be the aforesaid opposite edges of the strut arrangement.

The central member and the lateral members may provide the strut arrangement with the substantially U shaped end profile.

The holder may be configured to receive the support article.

The holder may be elongate. The holder may comprise a pair of holding members. The holding members may extend parallel to each other.

Each holding member may comprise a side member arranged at a respective side of the holder. The holding members may be attached to the strut arrangement.

The holding members may be integrally attached to the strut arrangement, for example, by welding. The holding members may be integrally attached to an end of the strut, for example, a lower end of the strut.

Each holding member may be substantially flat. Each holding member may comprise a holding plate. Each holding member may be substantially rectangular.

The holding members may be arranged opposite each other on the strut arrangement. The second part of the suspension assembly may be received between the holding members.

The holding members may define therebetween an open face of the holder. The holder may have a pair of opposite edges.

The pair of edges of the holder may define the aforesaid open face of the holder. The holding members may have the aforesaid pair of opposite edges.

The open face of the holder may be arranged adjacent the open face of the strut arrangement. The pair of opposite edges of the holder may extend from the pair of opposite edges of the strut arrangement.

The open face of the holder may be an upper open face of the holder.

The holding members may define therebetween a further open face of the holder. The further open face of the holder may be arranged opposite the aforesaid open face of the holder.

The further open face of the holder may be a lower open face of the holder.

The holder may have a pair of further opposite edges. The pair of further opposite edges may define the further open face of the holder.

The holder may have a locating formation to locate the stiffening apparatus relative to the suspension assembly. The locating formation may engage the support article to locate the main part relative to the suspension assembly.

The locating formation may extend across the holder. The locating formation may extend at least partially across the second open face of the holder.

The holder may have a pair of the locating formations. Each locating formation may extend from a respective one of the further opposite edges.

The holding members may be configured to receive the aforesaid part of the suspension assembly therebetween. The holding members may be configured to receive the support article therebetween.

A lower end region of the central member may extend between the holding members to provide the securing element. Each holding member may be substantially flat.

The lower end region may be bent from the rest of the central member to extend between the holding members, thereby forming the securing element.

The holder may further include securing elements to secure the holder to the suspension assembly. The holding members may define holes for receiving the securing elements therethrough.

The securing elements may cooperate with the suspension assembly to secure the holder to the suspension assembly. The securing elements may cooperate with the support article to secure the holder to the suspension assembly.

The securing elements may comprise bolts. Nuts may be provided into which the bolts can be screwed.

The strut arrangement may have a main axis. The strut arrangement may be elongate. The strut arrangement may receive the suspension article along, or parallel to, the main axis.

The open face of the strut arrangement may extend the length of the strut arrangement. The open face of the strut arrangement may extend the length of the channel component.

The strut arrangement may include an elongate extension member, which may be fastened to the strut portion.

The extension member may be received by the strut portion. The extension member may have a substantially U shaped end profile. The extension member may have a channel configuration.

The extension member may have an open face. The extension member may have opposite return formations extending partially across the open face of the extension member. The open face of the extension member may allow the suspension article to be received in the extension member.

When the extension member is received by the strut arrangement, the open face of the extension member may face the central member.

The stiffening apparatus may include a fastener to fasten the extension member to the strut arrangement. The stiffening apparatus may include first and second fasteners to fasten the extension member to the strut arrangement. The first fastener may comprise a nut, such as a channel nut. The second fastener may comprise a bolt. The second fastener may tighten the first fastener against the return formations.

The strut arrangement may receive the extension member lengthwise along the strut arrangement. The extension member may be received in the strut arrangement.

The extension member may be received by the strut arrangement in a position in which the open face of the extension member faces inwardly of the strut arrangement.

The extension member may receive the suspension article lengthwise along the extension member. Thus, the suspension article is held by the strut arrangement within the extension member.

The extension member may extend upwardly from the strut arrangement. The length of the extension member may be such that the extension member extends from the strut arrangement to the roof support.

The securing element may extend across the holder. The securing element may extend between the holding members.

The securing element may extend from the strut arrangement. The securing element may be integral with the strut arrangement. The securing element may have retaining formations to retain the securing element on the holder.

The holding members may have corresponding formations to cooperate with the retaining formations, thereby retaining the securing element on the holder.

The securing element may define a hole through which a fastener, such as a bolt, can extend to cooperate with a nut, such as a channel nut, to secure the stiffening arrangement to the suspended support article.

The retaining and corresponding formations may comprise retaining lugs and apertures. The retaining formations may comprise retaining lugs on the securing element. The corresponding formations may be apertures defined by the holder.

The holder may extend in a first direction relative to the strut arrangement. The holder may extend in a forward direction relative to the strut arrangement.

The stiffening apparatus may comprise a connector, the connector may be provided on the main part. The connector may be provided on the holder.

The connector may connect the stiffening apparatus to a bracing assembly. The connector may include at least one tab. In one embodiment, the, or each, tab may be provided on the strut arrangement.

The, or each, tab may extend in a second direction relative to the strut arrangement. The, or each, tab may extend in a rearward direction relative to the strut arrangement.

The connector may be provided on the holder. The, or each, tab may extend inwardly towards each other from the holder. The, or each, tab may engage the support article when the securing element is secured to the suspension assembly.

When the, or each, tab engages the support article, the strut arrangement may be positioned so that the suspension article is received by the strut arrangement.

The connector may include projections to which the bracing assembly is connected. Each projection may be provided on a respective tab.

The connector may define an aperture for receipt of at least some of the bracing assembly therethrough. The projection may define the aperture.

The connector may extend in a direction opposite to the direction in which the holder extends from the strut arrangement. The connector may extend rearwardly of the main part.

The connector may be provided on the main part. The connector may extend in a second direction relative to the main part. The connector may extend rearwardly of the main part.

In one embodiment, the connector may be provided on the strut arrangement. The connector may extend diagonally from the strut arrangement. The connector may be attached to the central member.

In one embodiment, the connector may be provided on the holder, and may be aligned with the holding members of the holder. In another embodiment, the connector may be provided on the strut arrangement.

The connector may comprise a plurality of said projections. The connector may comprise two of said projections. The connector may define two of the apertures. Each projection may define a respective aperture.

The projections may extend from the tabs. In one embodiment, each of the projections extends from a respective holding member.

Alternatively, the connector may be devoid of the projections, comprising only the tabs extending from the holding members. In this embodiment, each tab may define a respective one of the apertures.

An obstructor may be secured to the extension member. The obstructor may extend across the open face of the extension member.

The obstructor may comprise a first and second further fasteners. The first further fastener may be received within the channel of the elongate extension member. The first further fastener may engage the return formations within the channel.

An engaging member may extend across the open face of the channel of the extension member. The engaging member may engage the return formations outside the channel. The engaging member may be a washer.

The engaging member may define a hole. The second further fastener may extend through the hole in the engaging member. The second further fastener may be attached to the first further fastener to secure the first further fastener and the engaging member against the return formations.

The first further fastener may be a nut, such as a channel nut. The second further fastener may be a bolt.

The stiffening apparatus may further include an elongate extension member, which may be fastened to the strut arrangement.

The extension member may be received by the strut arrangement. The extension member may have a substantially U shaped end profile. The extension member may have a channel configuration.

The extension member may have an open face. The extension member may have opposite overhanging formations extending partially across the open face. The open face may allow the suspension article to be received in the extension member.

The stiffening apparatus may include fasteners to fasten the extension member to the strut arrangement. The fasteners may comprise at least one bolt, and at least one nut, such as a channel nut. The fasteners may tighten the nuts against the overhanging formations.

The strut arrangement may receive the extension member lengthwise along the strut arrangement. The extension member may be received in the strut arrangement.

The extension member may be received by the strut arrangement in a position in which the open face of the extension member faces inwardly of the strut arrangement.

The extension member may receive the suspension article lengthwise along the extension member. Thus, the suspension article is held by the strut arrangement within the extension member.

The extension member may extend upwardly from the strut arrangement. The length of the extension member may such that the extension member extends from the strut arrangement to the roof support.

The holder may constitute a securing arrangement for securing the stiffening apparatus to the suspension assembly.

The stiffening apparatus may include an end cap, which may be arrangeable in the top of the extension member. The end cap may comprise an insert. The end cap may further include an upper cover. The insert may have an open face.

The cover may define a slot. The slot may have an open end. The open end may communicate with the open face to allow the suspension article to be received in the slot.

The insert may be received in the top end of the extension member, thereby mounting the end cap on the extension member. The cover may have a flange extending around the edge of the cover. The flange may overhang the insert. The flange may engage a top edge of the extension member when the end cap is mounted on the extension member.

In the embodiments shown, the end cap may be mounted on the top end of the extension member, and the suspension article may be held within the slot. This provides the advantage in the embodiments described herein that the suspension article is maintained by the end cap centrally within the extension member.

Embodiments of the invention will now be described by way of example only, with reference to the accompanying drawings, in which.

Figure 1:
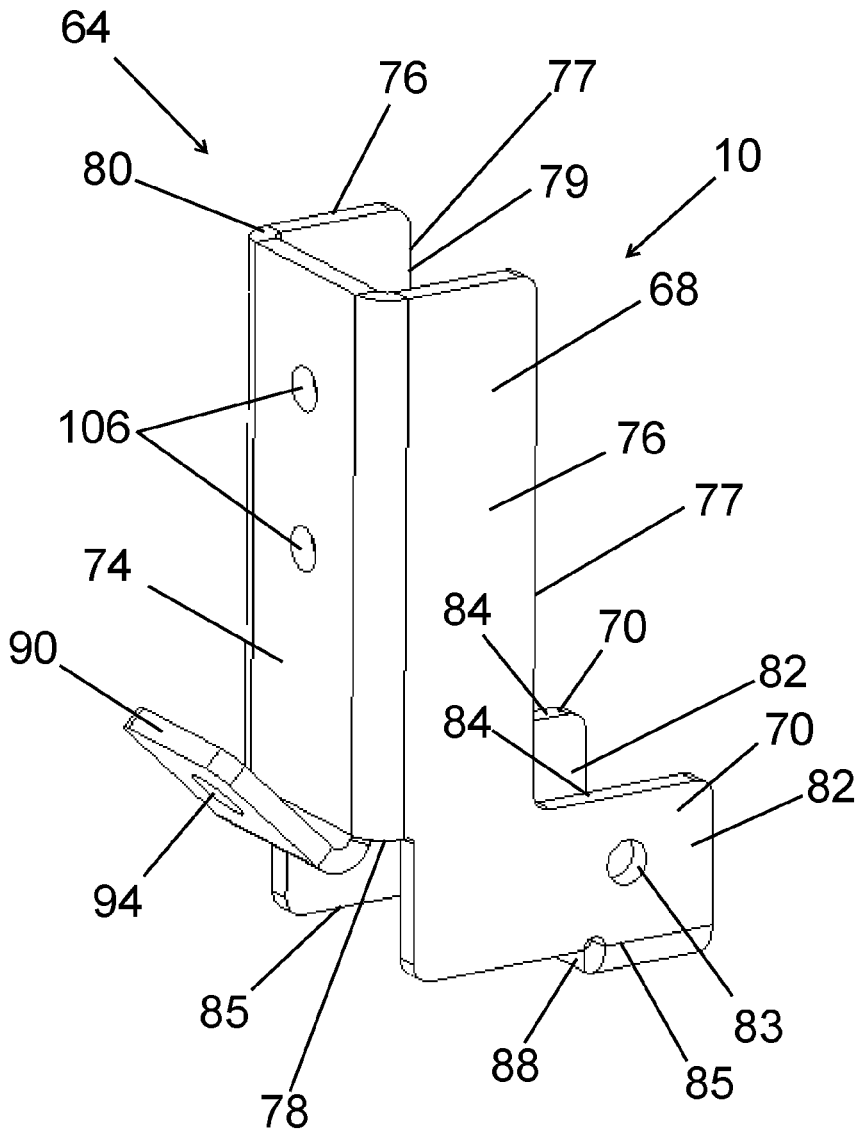
FIG. 1 is a perspective view from a first direction of a stiffening apparatus.
Figure 2:
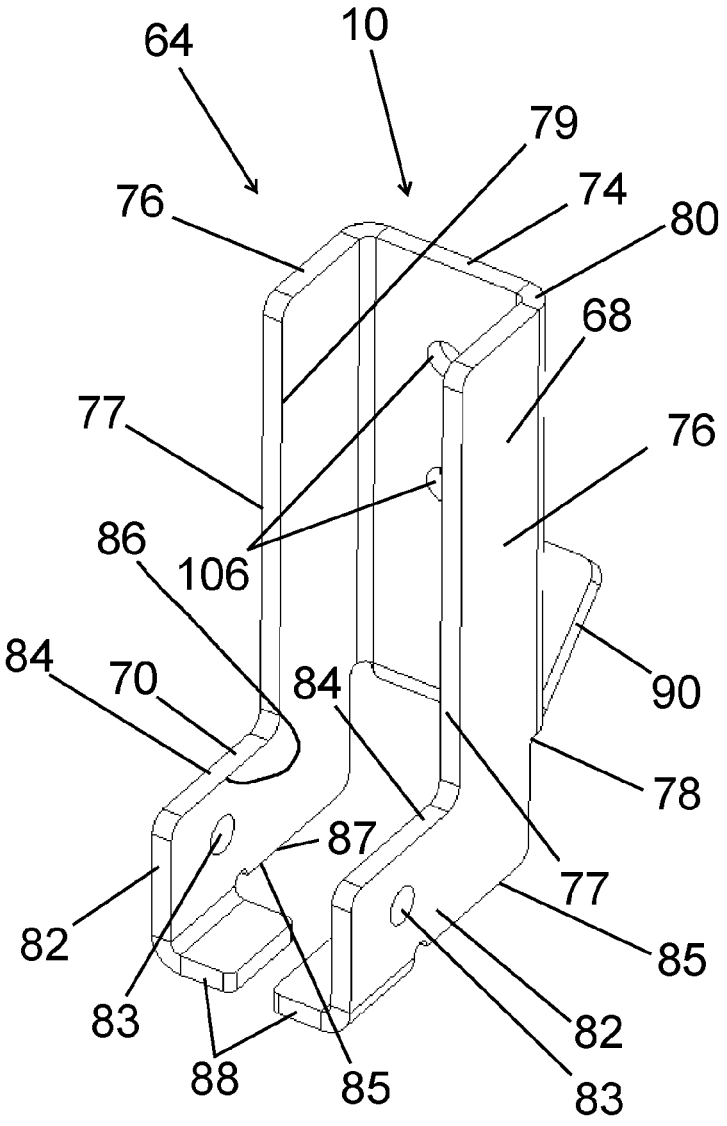
FIG. 2 is a perspective view from a second direction of a stiffening apparatus.
Figure 3:
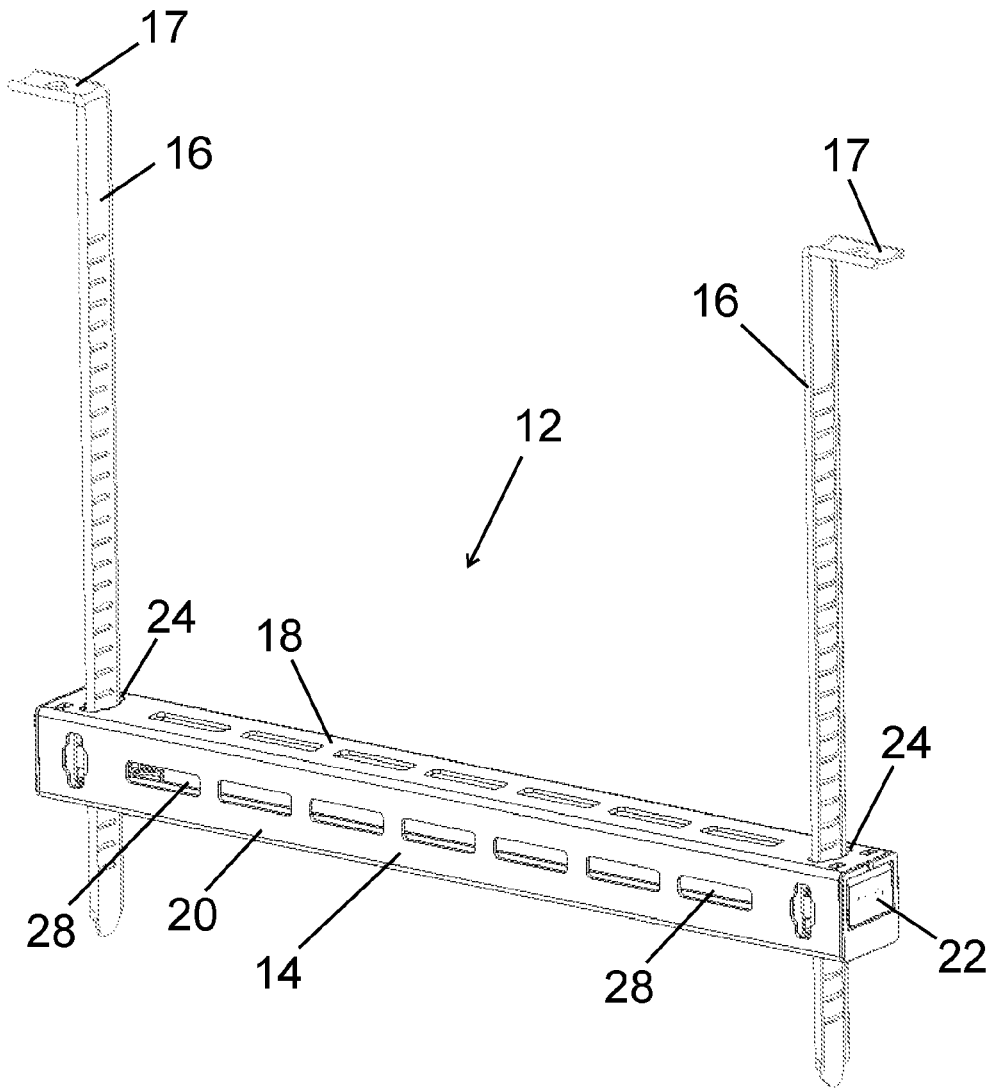
FIG. 3 shows a suspension assembly with which the stiffening apparatus is used.

FIGS. 1 and 2 show a main part 64 of a stiffening apparatus 10 for use in stiffening and bracing a suspension assembly 12 shown in FIG. 3. FIGS. 4 to 7 show two stiffening apparatuses 10 mounted on the suspension assembly 12.

Referring to FIG. 3, the suspension assembly 12 comprises an elongate support article 14 in the form of a channel support. A plurality of the suspension assemblies 12 are provided in succession along the roof or ceiling of a building, such as a warehouse, factory or the like. The suspension assemblies 12 are used to support various items, such as cable trays or pipes.

The suspension assembly 12 further includes two elongate suspension articles 16, the lower ends of which are locked within respective locking devices at opposite ends of the support article 14.

The upper ends 17 of the suspension articles 16 are attached to a ceiling or roof beam by any suitable means known in the art. The suspension articles 16 are in the form of straps or the like.

The elongate support article 14 has an upper planar member 18, and opposite elongate lateral planar members 20 extending from the planar member 18. The upper planar member 18 defines through apertures 24 adjacent each end of the support article 14.

The suspension articles 16 extend through the apertures 24. A locking mechanism 22 is provided at each opposite end of the support article 14, between the lateral planar members 20. The locking mechanisms 22 lock the suspension articles 16 to the support article 14.

Each of the lateral planar members 20 defines a plurality of slots 28 extending one after the other along the length of each lateral planar member 20.

GB2558759 discloses an example of a suitable suspension assembly. A further example of a suspension assembly is disclosed in UK patent application No. 2013103.3.

Referring to FIGS. 1 and 2, the main part 64 comprises an upstanding strut arrangement 68 and a holder 70 on the strut arrangement 68. The strut arrangement 68 receives the suspension article 16.

The strut arrangement 68 and the holder 70 extend substantially perpendicular to each other so that the main part 64 is substantially L shaped.

The holder 70 is provided for holding the support article 14. The holder 70 is provided on the strut arrangement 68.

The strut arrangement 68 is elongate and is in the form of an upstanding channel component having a substantially flat central member 74 and two opposed substantially flat lateral members 76 having free edges 77.

The lateral members 76 extend from the central member 74, their free edges 77 defining an open face 79 of the strut arrangement 68.

The central member 74 and the lateral members 76 provide the strut arrangement 68 with a substantially U shaped end profile. The strut arrangement 68 has open proximal and distal opposite ends 78, 80 (see FIGS. 1 and 2).

The holder 70 may be elongate and extends from the proximal end 78 of the strut arrangement 68. The holder 70 extends in one direction, i.e. in a forward direction, from the strut arrangement 68.

The open face 79 of the strut arrangement 68 faces in the same direction as the direction in which the holder 70 extends from the strut arrangement 68.

Figure 4:
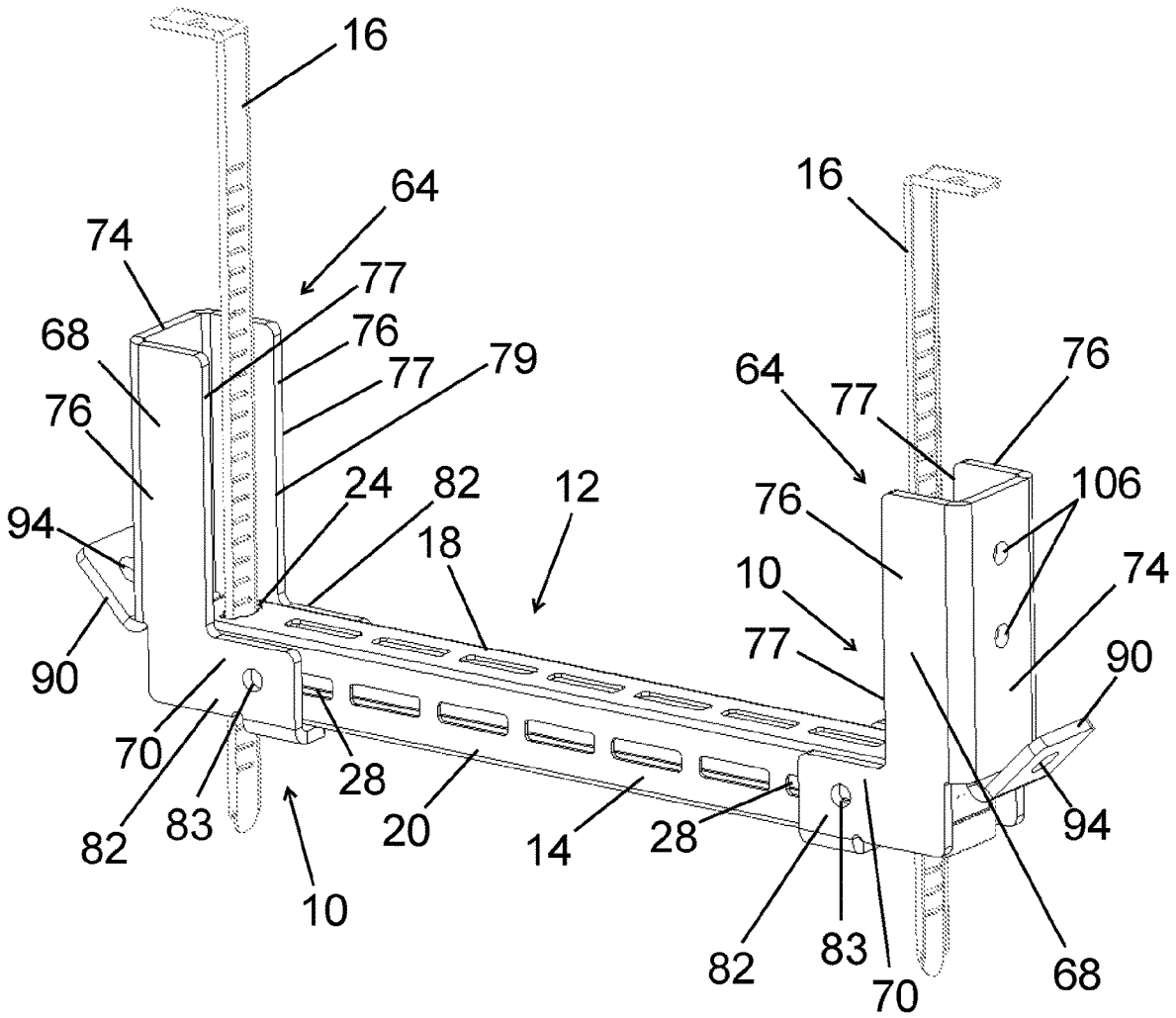
FIG. 4 is a perspective view of the suspension assembly, showing main parts of two stiffening apparatuses being mounted thereon.
Figure 5:
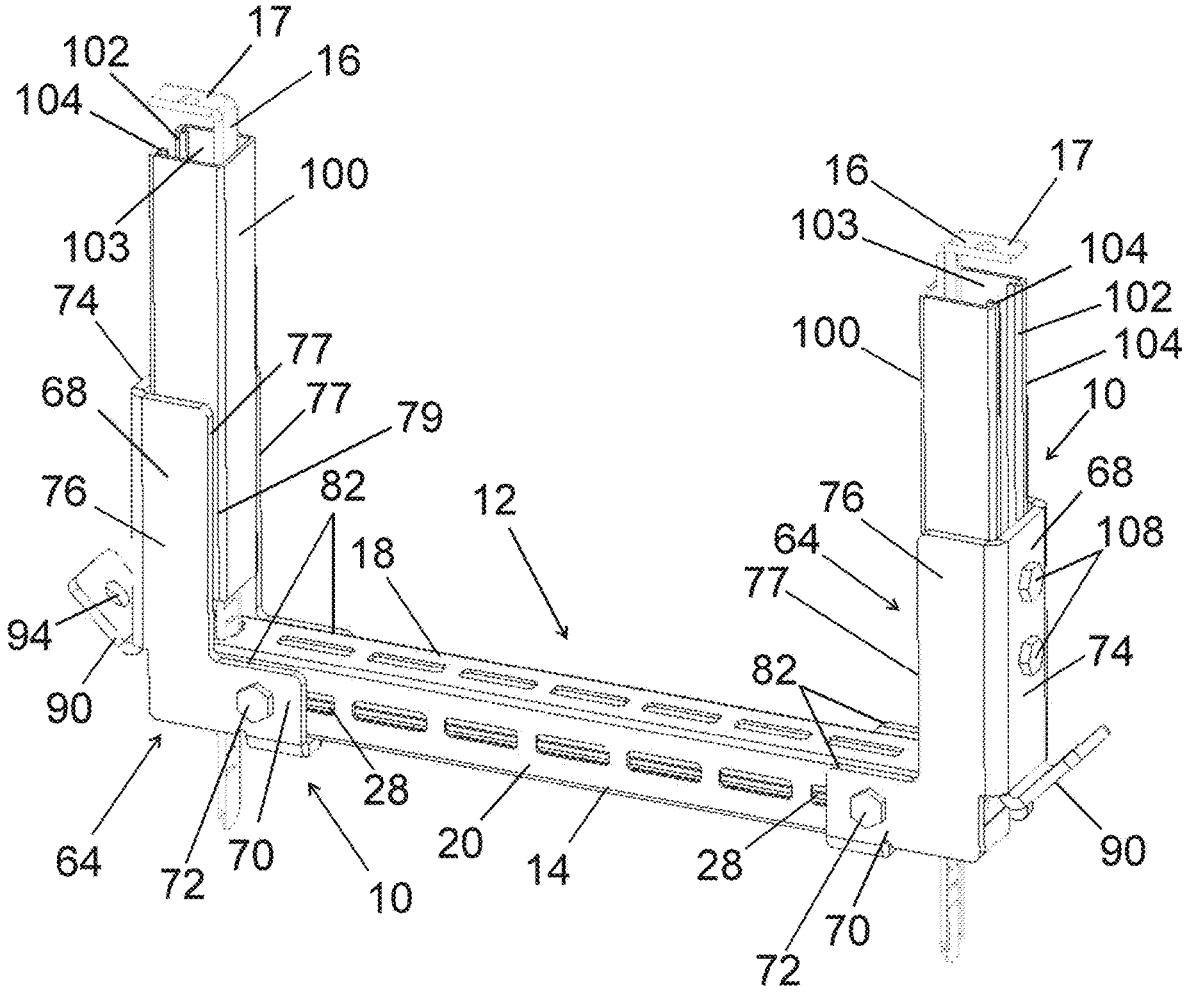
FIG. 5 is a perspective view showing a further step of the stiffening apparatuses being mounted on the suspension assembly.
Figure 6:
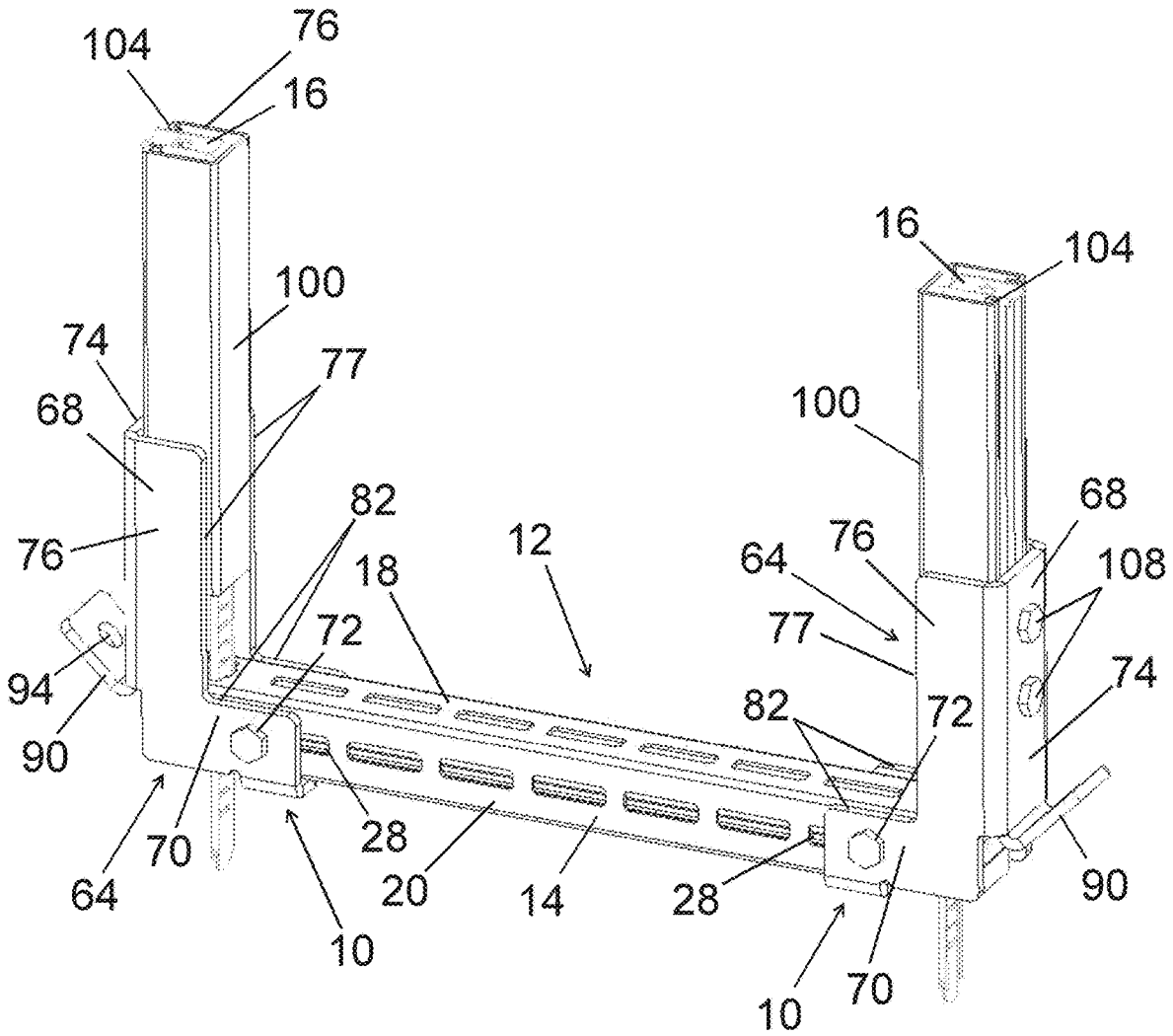
FIG. 6 is a perspective view showing the stiffening apparatuses mounted on the suspension assembly.

The holder 70 comprises a pair of opposite substantially flat holding members 82. As shown in FIGS. 4 to 6, the holding members 82 receive the support article 14 therebetween.

The holder 70 is in the form of a securing arrangement and further includes securing elements 72 in the form of bolts. The holding members 82 are secured to the support article 14 by means of the securing elements 72.

Each holding member 82 defines a hole 83 through which a respective one of the securing elements 72 extends. Each securing element 72 also extends through a respective one of the slots 28 in each of the lateral planar members 20 of the support article 14, and is screwed into a respective nut, thereby securing the holding members 82 to the support article 14.

The stiffening apparatus 10 further includes a connector in the form of a projection 90 on the main part 64. The projection is provided to connect the main part 64 to a bracing assembly 92. The projection 90 extends from the central member 74 at the proximal end 78 of the strut arrangement 68.

The projection 90 extends from the strut arrangement 68 in the opposite direction to the direction in which the holder 70 extends, i.e. in a rearward direction from the strut arrangement 68.

Figure 7:
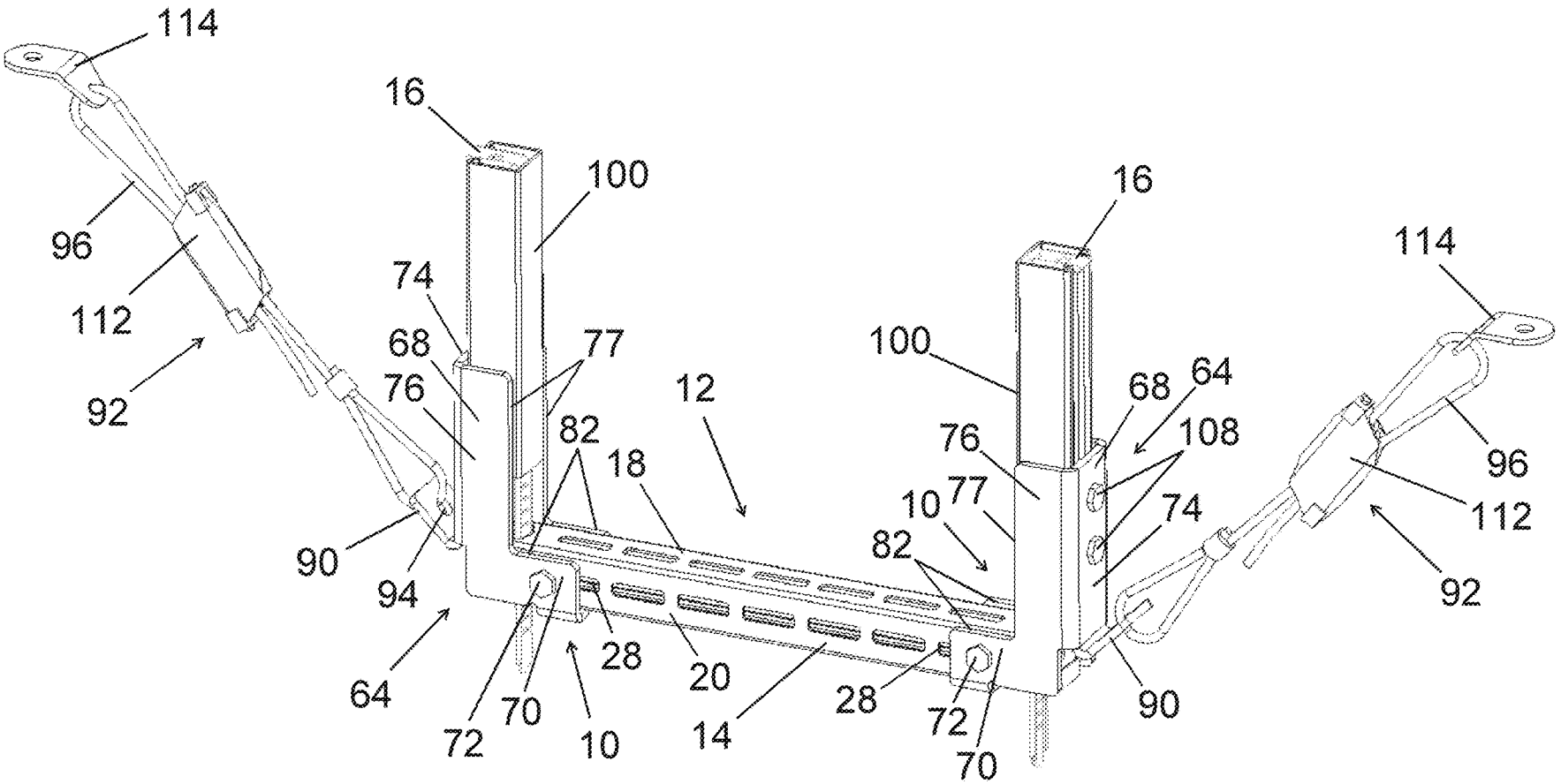
FIG. 7 is a perspective view similar to FIG. 6, in which the stiffening apparatuses are connected to a bracing assembly.

The projection 90 defines an aperture 94. As shown in FIG. 7, cables 96, forming part of respective bracing assemblies 92, extend through the apertures 94 in the projections 90. This effects the connection of the main part 64 to the bracing assembly 92.

Each of the bracing assemblies 92 shown in FIG. 7 is a known bracing assembly 92 of which the skilled person would be aware.

Referring to FIG. 4, the main part 64 of each stiffening apparatus 10 is arranged in use over a respective opposite end region of the support article 14. As shown, the support article 14 is received between the holding members 82 of the holder 70.

The main part 64 of each stiffening apparatus 10 can be moved along the support article 14 until each main part 64 is in a desired position relative to the support article 14. In said desired position, the hole 83 in each holding member 82 is aligned with a respective slot 28 in the support article 14.

The securing elements 72 can then be inserted through the respective holes 83 and slots 28, and screwed into the nuts, thereby securing the support article 14 to the main part 64.

Each holding member 82 has an upper edge 84 and a lower edge 85. The upper edges 84 define therebetween an upper open face 86. The lower edges 85 define therebetween a lower open face 87.

The upper open face 86 extends from the open face 79 of the strut arrangement 68. A locating member 88 extends from each lower edge 85 towards the opposite lower edge 85.

When the holding member 82 is secured to the support article 14 by the securing elements 72, the locating members 87 engage the lower edges of the lateral planar members 20, thereby locating the strut arrangement 68 in position perpendicular to the support article 14.

When the main part 64 is so arranged, the suspension article 16 is received by, and extends along, the strut arrangement 68. The suspension article 16 extends through the open proximal and distal ends 78, 80 of the strut arrangement 68.

Referring to FIGS. 5, 6, and 7, the strut arrangement 68 further includes an elongate extension member 100 for protecting the suspension article 16 from deformation, for example, during a seismic event.

The elongate extension member 100 defines a channel 103 having an open face 102. Opposite return formations 104 extend partially across the open face 102 of the extension member 100.

The extension member 100 is received in the strut arrangement 68 in an orientation in which the open face 102 of the extension member 100 faces the central member 74 of the strut arrangement 68. Thus, when the strut arrangement 68 receives the extension member 100, the suspension article 16 is received through the open face 102 into channel 103 of the extension member 100.

The extension member 100 is provided to extend the strut arrangement 68 to the ceiling or roof support, so that the suspension article 16 is protected along the whole of its length. The extension member 100 extends upwardly from the strut arrangement 68.

The extension member 100 is cut to a selected length so that the extension member 100 extends from the strut arrangement 68 and abuts against the ceiling or roof support. Thus, the suspension article 16 is protected along the whole of its length by the extension member 100.

First fasteners in the form of two channel nuts (not shown) are provided within the extension member 100. The central member 74 of the strut arrangement 68 defines two openings 106 through which second fasteners 108 in the form of two bolts can be received, thereby fastening the strut arrangement 68 to the extension member 100, as explained below.

The two openings 106 are positioned to provide adjustment of the extension member 100, e.g. by 1.5" (38 mm), along the strut arrangement 68, thereby allowing for the extension member being inaccurately cut to the selected length.

The fasteners 108 extend through the openings 106, and through the open face 102 of the extension member 100. The fasteners 106 are screwed into the channel nuts to tighten the channel nuts against the return formations 104 of the extension member 100, thereby securing the extension member 100 to the strut arrangement 68.

Thus, the stiffening apparatus 10 is mounted on the suspension assembly 12. The bracing assemblies 92 can then be connected to each stiffening apparatus 10 by passing the cables 96 through the projections 90, and securing the ends of cables 96 to each other using a respective clamping device 112, as shown in FIG. 7. The bracing assemblies 90 are attached, by any means known in the art, to the roof beam or ceiling using a suitable attaching member 114.

There is thus described a stiffening apparatus 10 that, in the embodiment described herein, has the advantage that it can be easily mounted on the suspension assembly 12, either during installation of the suspension assembly 12, or afterwards. The stiffening apparatus 10 protects the suspension assembly 12 against seismic activity.

The above described embodiment of the stiffening apparatus 10 has the advantage that it can be installed at service level, which means that there is no need for the installer to move closer to the ceiling to fully strengthen the system, thereby reducing installation time, whilst avoiding difficulties associated with health and safety.

The open face 79 allows the stiffening apparatus 10 to be retrofitted on the suspension assembly 12.

The embodiment of the stiffening apparatus 10 described herein, can be provided as a single unit, with all fastenings already attached. This saves labour time and is simpler compared to installing prior art apparatus comprising multiple separate components.

Furthermore, the stiffening apparatus 10 allows enough space for power tools to be used to tighten the securing features to the supporting elements.

The stiffening apparatus 10 can be used in stiffening products, such as the suspension assembly 12, or apparatus that may not be able to withstand compressive load.

The stiffening apparatus 10 provides the suspension assembly 12 and other apparatus with the required rigidity. The stiffening apparatus 10 helps prevent damage to suspended building components, e.g. piping, electrical baskets and trays, and the like.

The stiffening apparatus 10 allows the installer to use the suspension assembly 12 to suspend building components in buildings constructed in regions subject to seismic problems. Such installers would be constrained to installing systems using threaded rods if the stiffening apparatus 10 was not available. The stiffening apparatus 10 is faster to install than systems using threaded rods and is, therefore, more economically viable.

Figure 8:
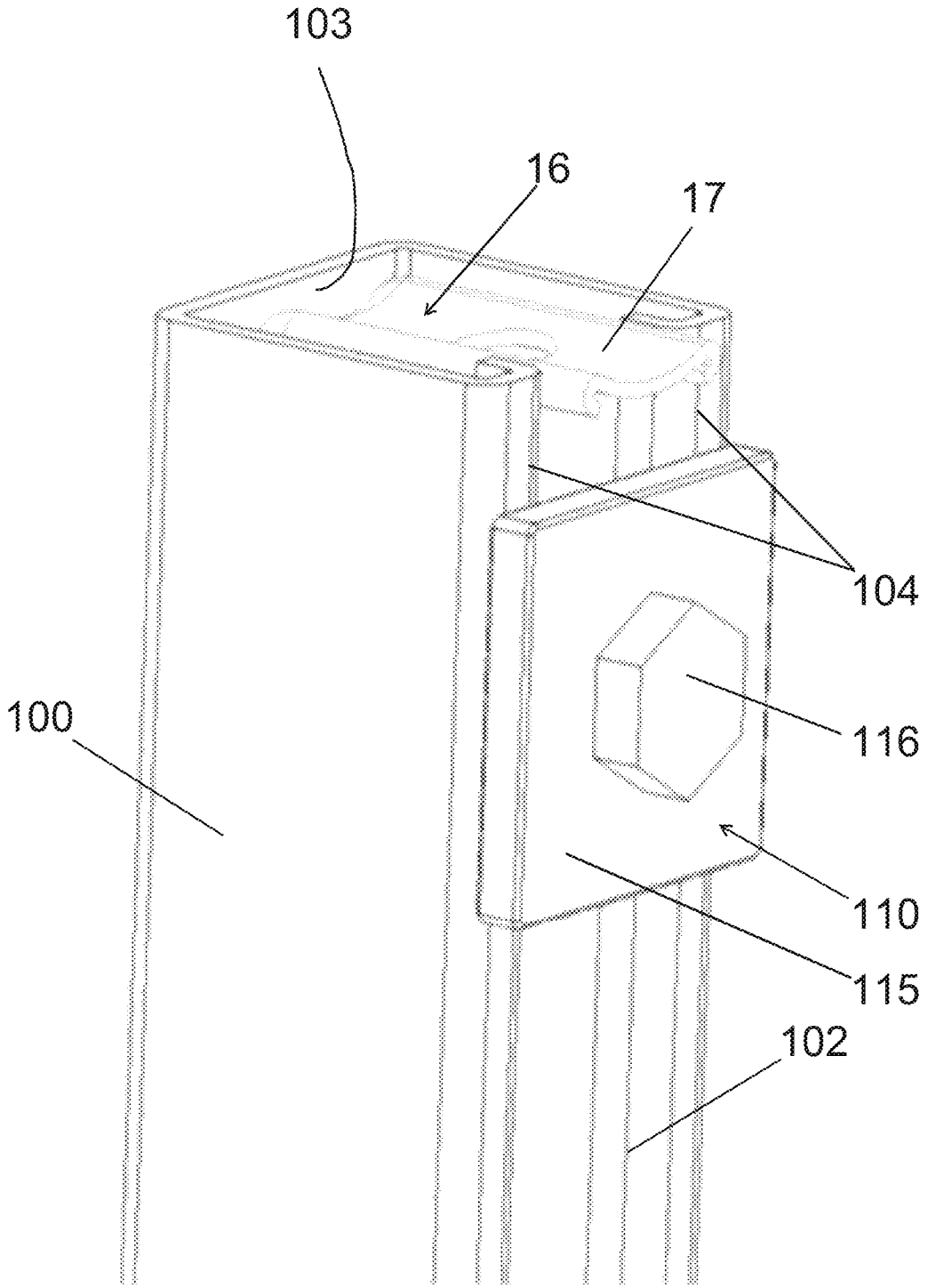
FIG. 8 is a close up view of a region of the stiffening apparatus in use, showing an obstructor.
Figure 9:
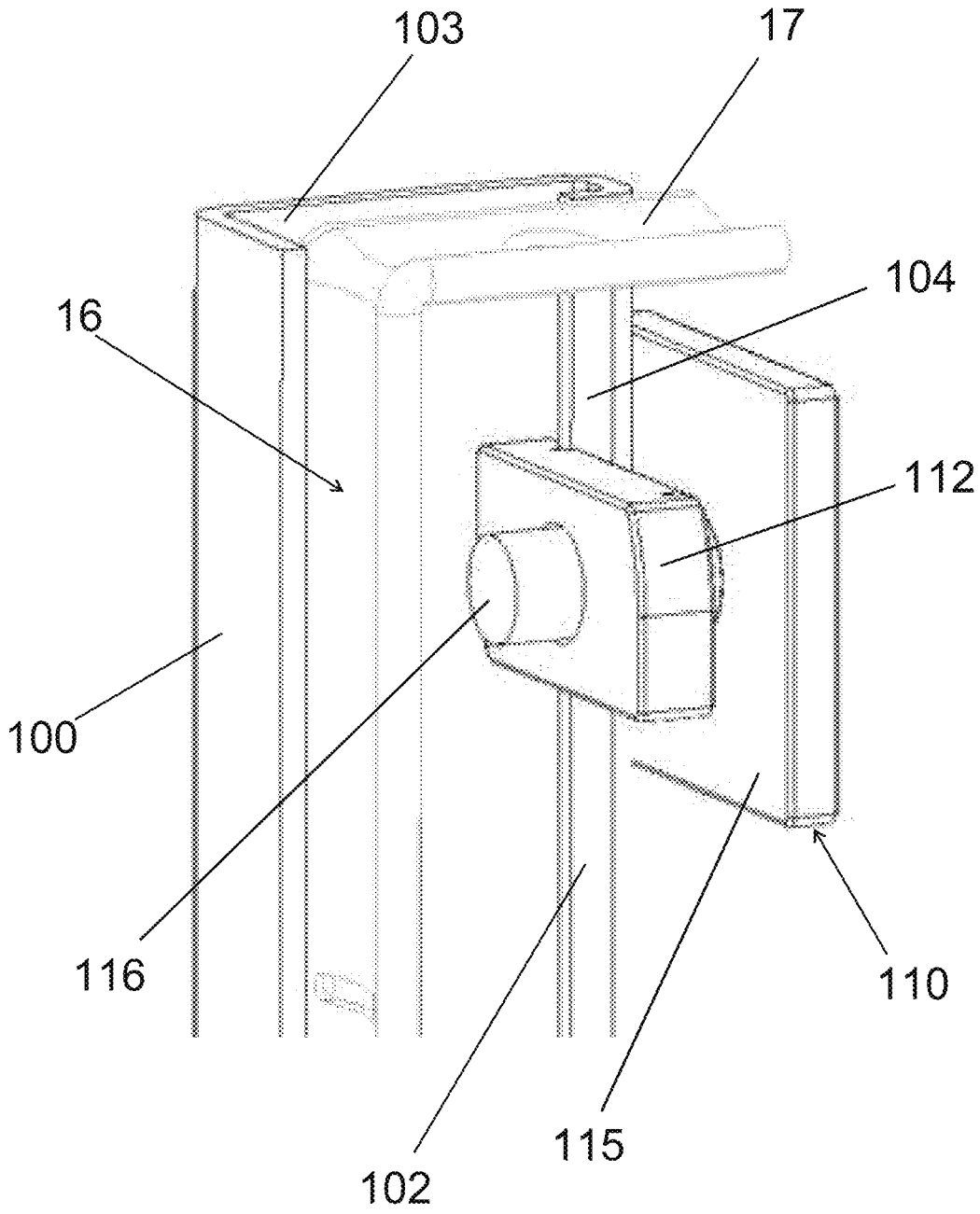
FIG. 9 is a sectional side view of the region of the stiffening apparatus shown in FIG. 8.
Figure 10:
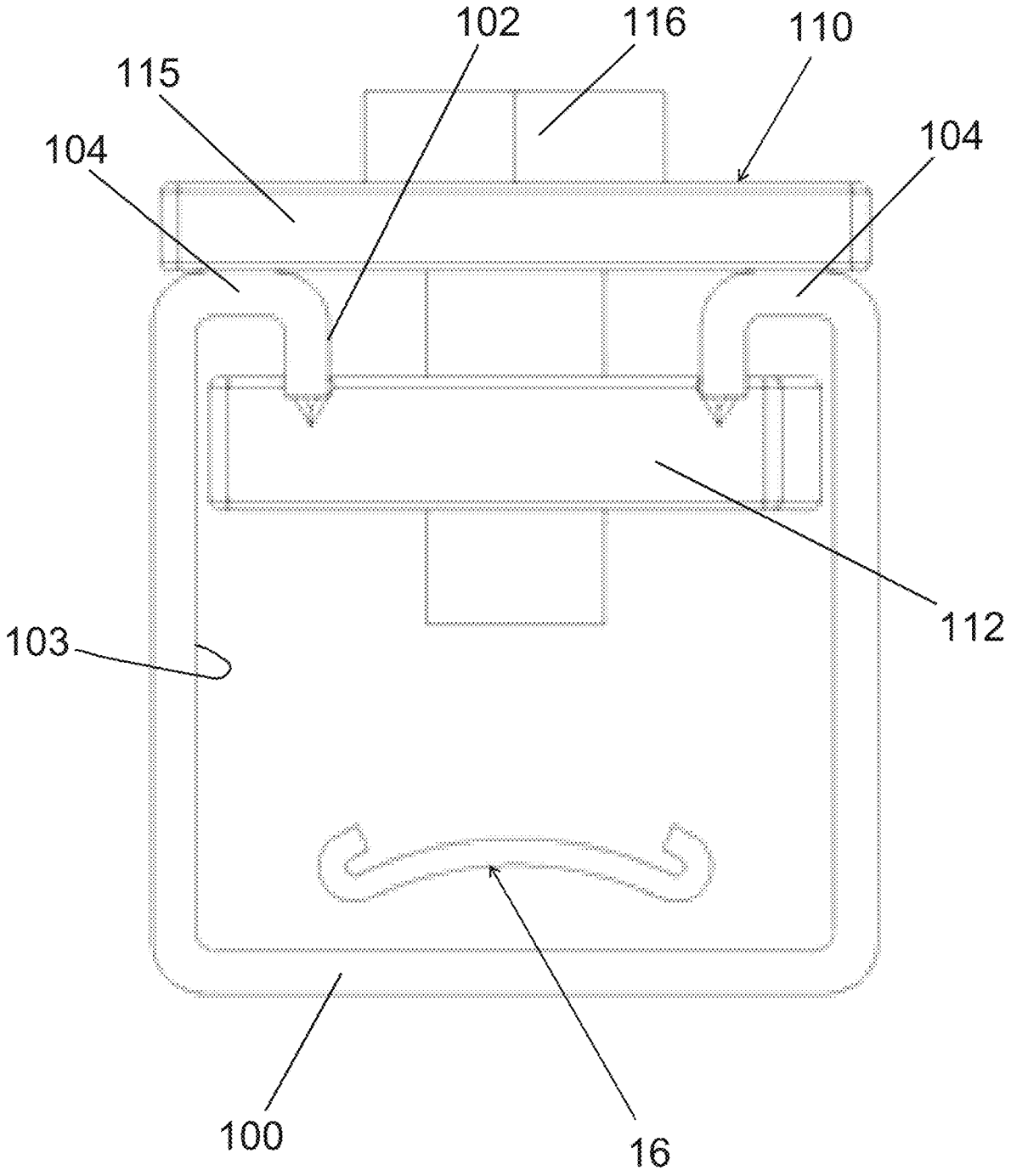
FIG. 10 is a sectional top view of the region of the stiffening apparatus shown in FIGS. 8 and 9.

A modification is shown in FIGS. 8, 9 and 10, in which an obstructor 110 is secured to the elongate extension member 100. The obstructor 110 extends across the open face 102.

The obstructor 110 prevents the suspension article 16 passing through the open face 102 in the event that the elongate extension member 100 moves away from its vertical position during a seismic event. Thus, the obstructor 110 maintains the elongate extension member 100 in its position within the channel 103.

The obstructor 110 comprises a first further fastener in the form of a channel nut 112 (see FIGS. 9 and 10). The channel nut 112 is received within the channel 103 of the elongate extension member 100.

The channel nut 112 engages the return formations 104 within the channel 103. A washer 115 extends across the open face 102 and engages the return formations 104 outside the channel 103. In the embodiment shown, the washer 115 is square, but it will be appreciated that it could be any suitable shape.

A second further fastener in the form of a bolt 116 extends through a hole in the washer 115. The bolt 116 is screwed into the channel nut 112. The bolt 116 tightens the channel nut 112 and the washer 115 against the return formations 104, thus securing the obstructor 110 to the elongate extension member 100 across the open face 102 thereof.

Figure 11:
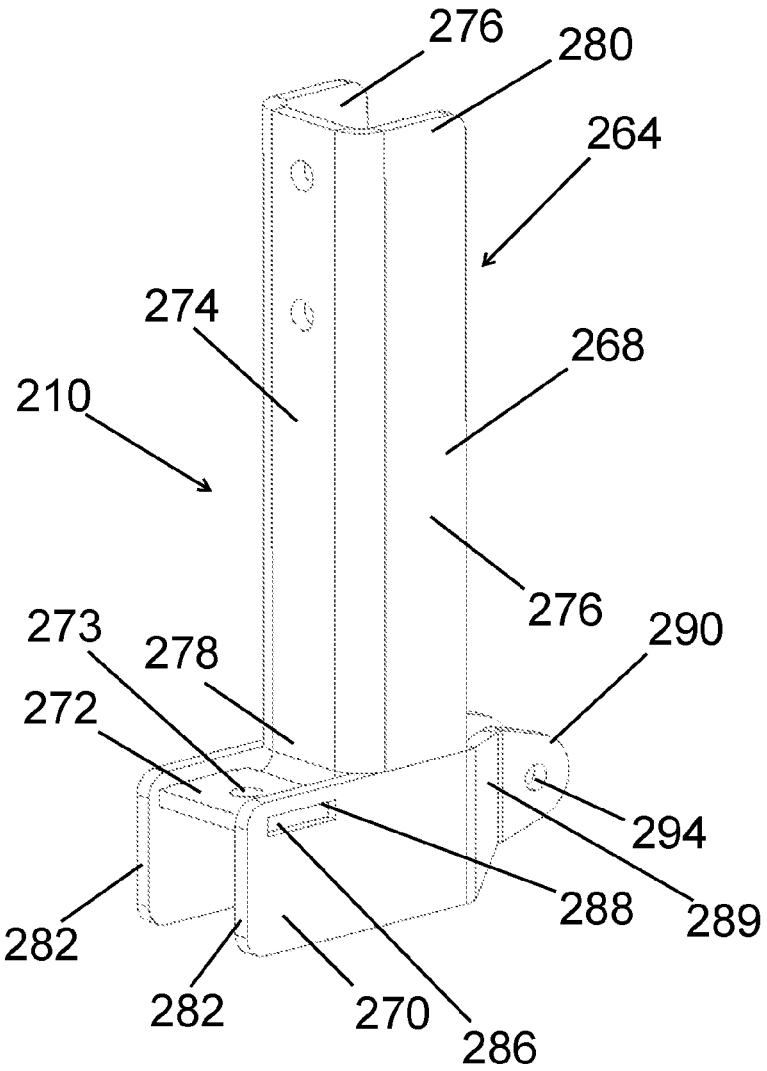
FIG. 11 is a perspective view from a first direction of a further stiffening apparatus.
Figure 12:
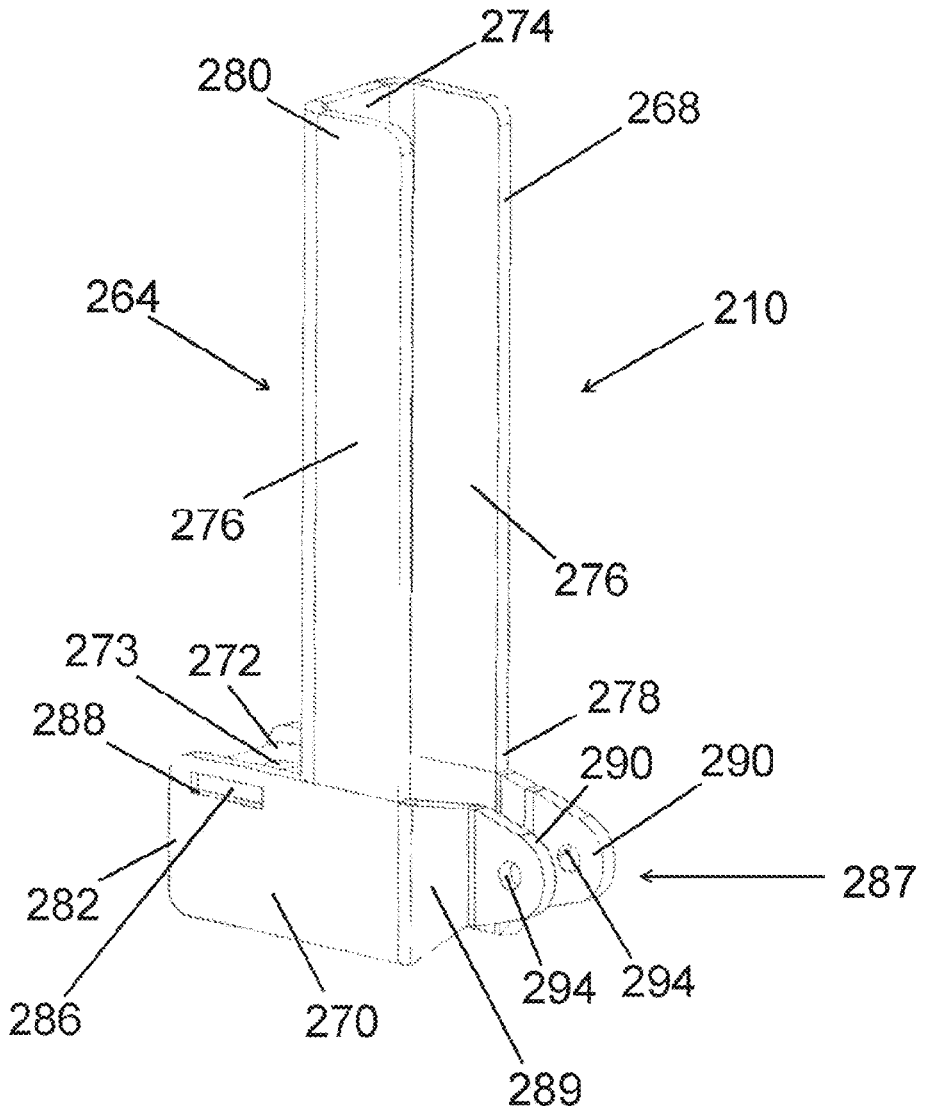
FIG. 12 is a perspective view from a second direction of the stiffening apparatus shown in FIG. 11.
Figure 13:
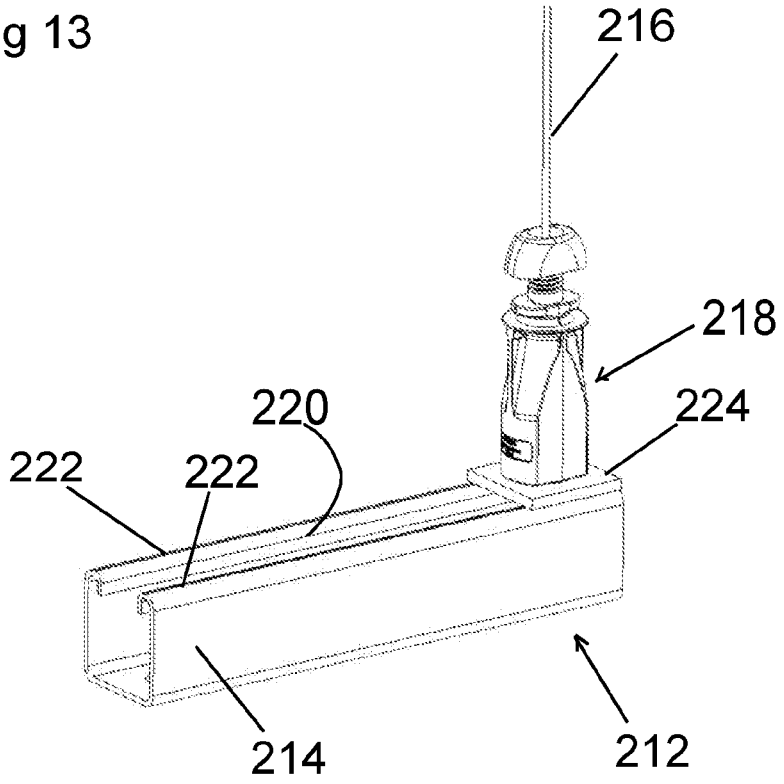
FIG. 13 shows one end region of a suspension assembly with which the stiffening apparatus shown in FIGS. 11 and 12 can be used.
Figure 15:
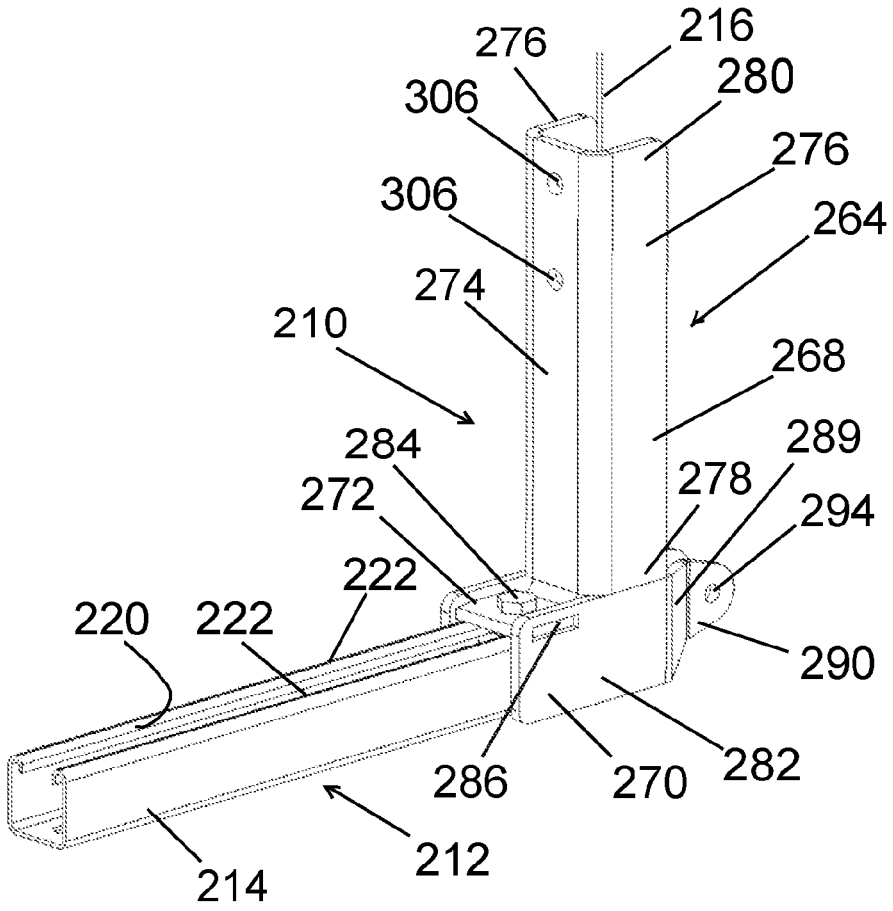
FIG. 15 is a perspective view from the first direction of the stiffening apparatus shown in FIGS. 11 and 12 mounted on the suspension assembly.

FIGS. 11 and 12 show a stiffening apparatus 210 for use in stiffening and bracing a suspension assembly 212. A lower end region of the suspension assembly 212 is shown in FIG. 13. FIG. 15 shows the stiffening apparatus 210 mounted on the suspension assembly 212.

Referring to FIG. 13, the suspension assembly 212 comprises an elongate support article 214 in the form of a channel support. A plurality of the suspension assemblies 212 are provided in succession along the roof or ceiling of a building, such as a warehouse, factory or the like.

The suspension assemblies 212 are used to support various items, such as cable trays or pipes.

The suspension assembly 212 further includes two elongate suspension articles 216, the lower ends of which are clamped within respective clamping devices 218 attached at opposite ends of the support article 214. Only one of the clamping devices 218 is shown in FIG. 13.

The upper ends of the suspension articles 216 are attached to a ceiling or roof beam by any suitable means known in the art. The suspension articles 216 are in the form of wires, cables, wire ropes or the like.

The elongate support article 214 has an upper open face 220, and opposite overhanging formations 222 extending partially across the open face 220. A respective attachment plate 224 is provided at each opposite end of the support article 214, and extends across the open face 220. An aperture 226 is defined in each attachment plate 224 (see FIG. 19).

Figure 14:
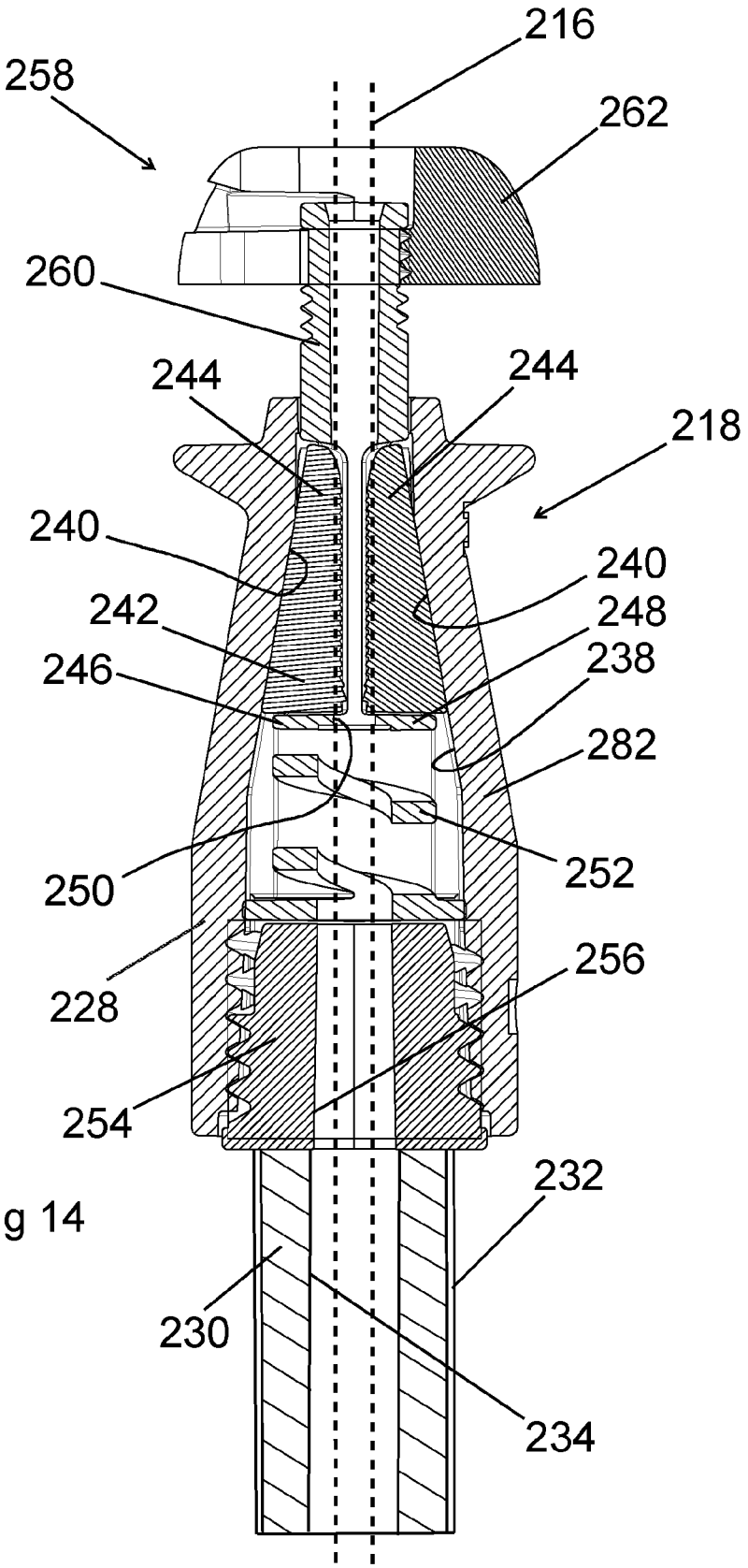
FIG. 14 shows a clamping device for use in the suspension assembly shown in FIG. 13.

FIG. 14 shows one of the clamping devices 218. GB 2560418 A discloses a securing device that could be used as the clamping device 218.

The clamping device 218 comprises a body 228 and a fastening portion 230 projecting from the body 228. The securing device disclosed in GB 2560418 A possesses all the features of the clamping device 218 with the exception of the fastening portion 230.

The fastening portion 230 is in the form of a tube on an end of the body 228. The fastening portion 230 has external threads 232, and defines an end bore 234.

Figure 18:
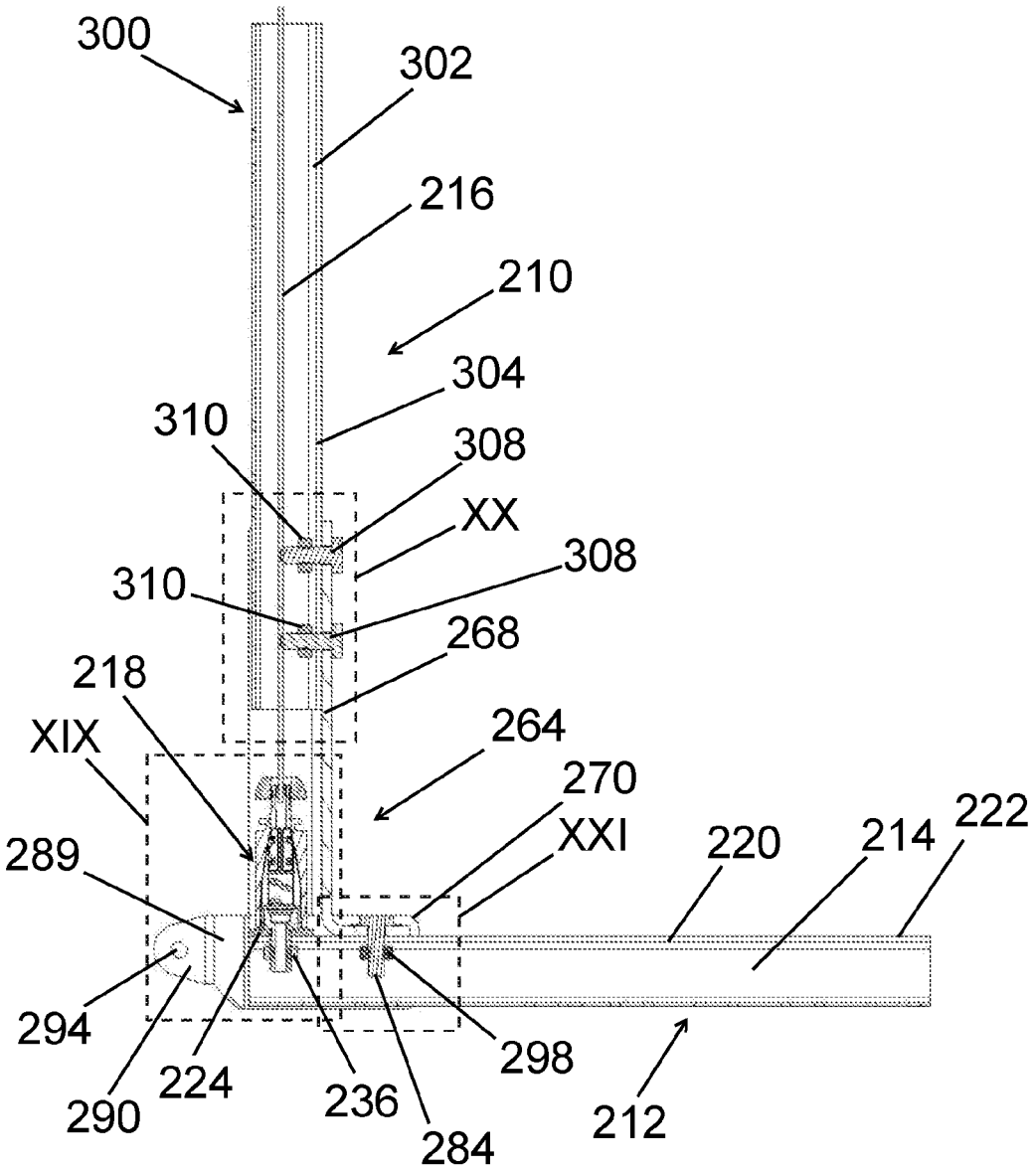
FIG. 18 is a sectional side view of the stiffening apparatus shown in FIGS. 11 and 12 mounted on the suspension assembly.
Figure 19:
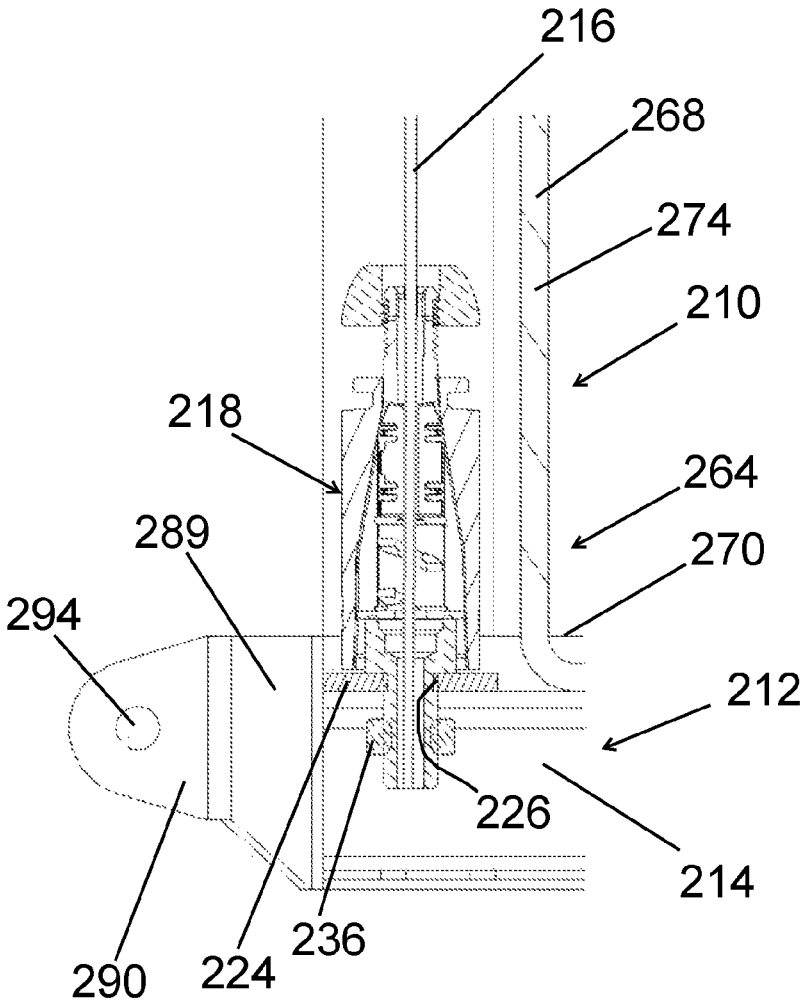
FIG. 19 is a close up view of the region marked XIX in FIG. 18.
Figure 20:
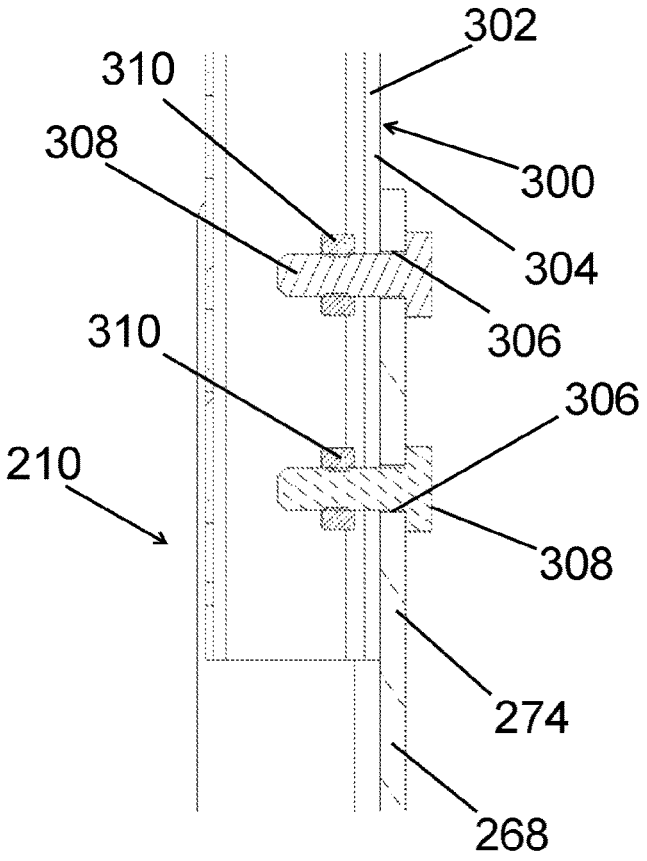
FIG. 20 is a close up view of the region marked XX in FIG. 18.

In use, the fastening portion 230 of each clamping device 218 is inserted through the respective apertures 226 in the attachment plates 224. The fastening portion 230 of each clamping device 218 is screwed into channel nuts 236 within the support article 214, as shown in FIGS. 18 and 19.

The channel nuts 236 are tightened against the overhanging formations 222, thereby attaching the clamping devices 218 to the support article 214.

The body 228 of the clamping device 218 has a single passage 238 to receive the suspension article 216 therethrough. The body 228 has opposite internal wall portions 240 defining the passage 238. The wall portions 240 converge towards each other.

The clamping device 218 further includes a clamping mechanism 242 for clamping the suspension article 216. The clamping mechanism 242 comprises two clamping members 244 in the form of wedges. The clamping mechanism 242 further comprises a carriage 246 on which the clamping members 244 are carried.

The clamping members 244 are arranged on the carriage 246 opposite each other. The carriage 246 further includes a platform 248 on which the clamping members 244 are seated.

The platform 248 defines a hole 250 through which the suspension article 216 extends. The suspension article 216 is shown in broken lines in FIG. 14.

The suspension article 216 extends through the passage 238, between the clamping members 244, through the hole 250 in the platform 248, and through the end bore 234 in the fastening portion 230.

The clamping mechanism 242 further includes an urging member 252 and an abutment 254 at one end of the body 228. The urging member 252 is in the form of a coil spring.

The fastening portion 230 projects from the same end of the body 228 at which the abutment 254 is provided.

The urging member 252 extends between the abutment 254 and the platform 248 to urge the carriage 246 along the passage 238. The carriage 246 is urged by the urging member 252 in the direction of the inward converging of the wall portions 240.

The abutment 254 defines a communicating bore 256 between the passage 238 and the end bore 234. The suspension article 216 extends through the communicating bore 256 to the end bore 234.

As the carriage 246 is so urged, the clamping members 244 slide along the converging wall portions 240 and move towards each other from a released position to a clamping position.

In the released position, the clamping members 244 are disengaged from the suspension article 216. In the clamping position, the clamping members 244 engage the suspension article 216, whereby the suspension article 216 is clamped between the clamping members 244.

The clamping device 218 includes a release arrangement 258 for moving the clamping members 244 to the released position.

The release arrangement 258 comprises an extension member 260 on the carriage 246, and a pressable member 262 screwed onto the extension member 260. The extension member 260 extends from the carriage 246 through the top end of the body 228.

A user can press the release arrangement 258 into the body 228, thereby pushing the carriage 246 towards the abutment 254. This moves the clamping members 244 from a narrower region of the passage 238 to a wider region of the passage 238, thereby moving the clamping members 244 from the clamping position to the release position.

Referring to FIGS. 11 and 12, the stiffening apparatus 210 comprises a main part 264. The main part 264 comprises an upstanding strut arrangement 268 and a holder 270 on the strut arrangement 268.

The strut arrangement 268 and the holder 270 extend substantially perpendicular to each other so that the main part 264 is substantially L shaped.

The holder 270 comprises a securing element 272 for securing the main part 264 to the support article 214. The holder 270 extends in a first direction, i.e. in a forward direction relative to the strut arrangement 268.

The strut arrangement 268 is elongate and is in the form of an upstanding channel component having a substantially flat central member 274 and two substantially flat lateral members 276. The lateral members 276 extend from the central member 274.

The central member 274 and the lateral members 276 provide the strut arrangement 268 with a substantially U shaped end profile. The strut arrangement 268 has open proximal and distal opposite ends 278, 280.

Figure 17:
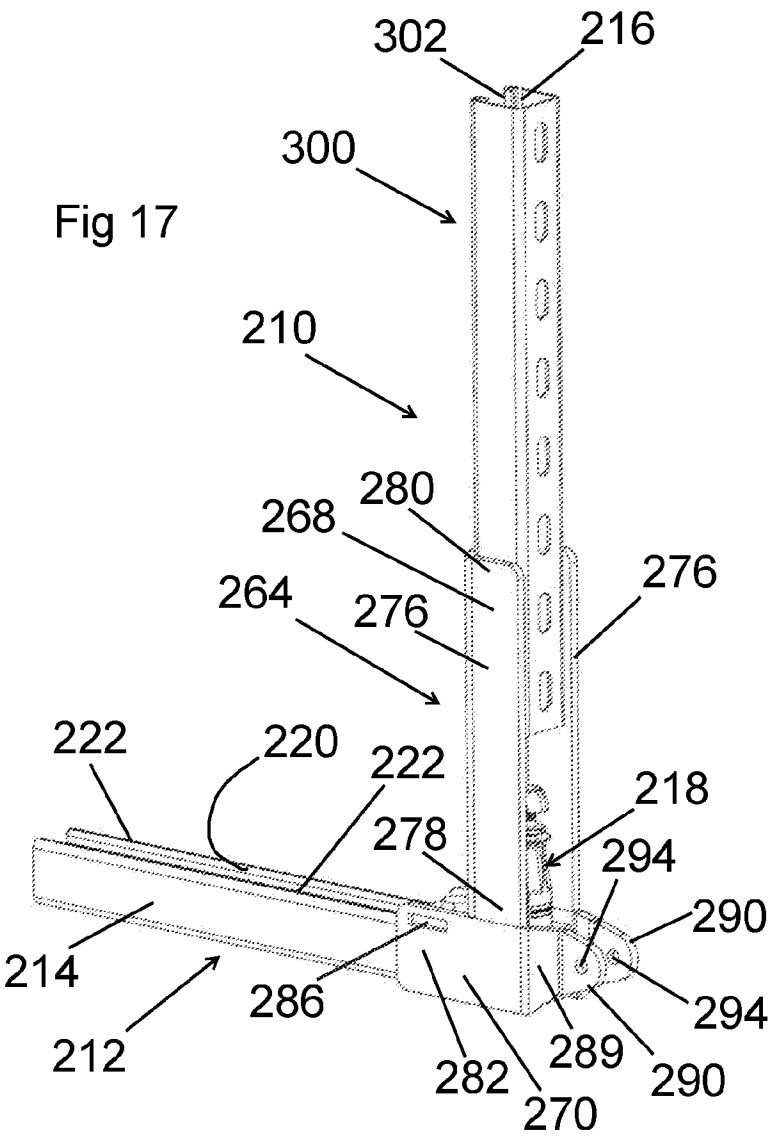
FIG. 17 is a perspective view from the second direction of the stiffening apparatus shown in FIGS. 11 and 12, in which the extension member is fastened to a strut portion.
Figure 16:
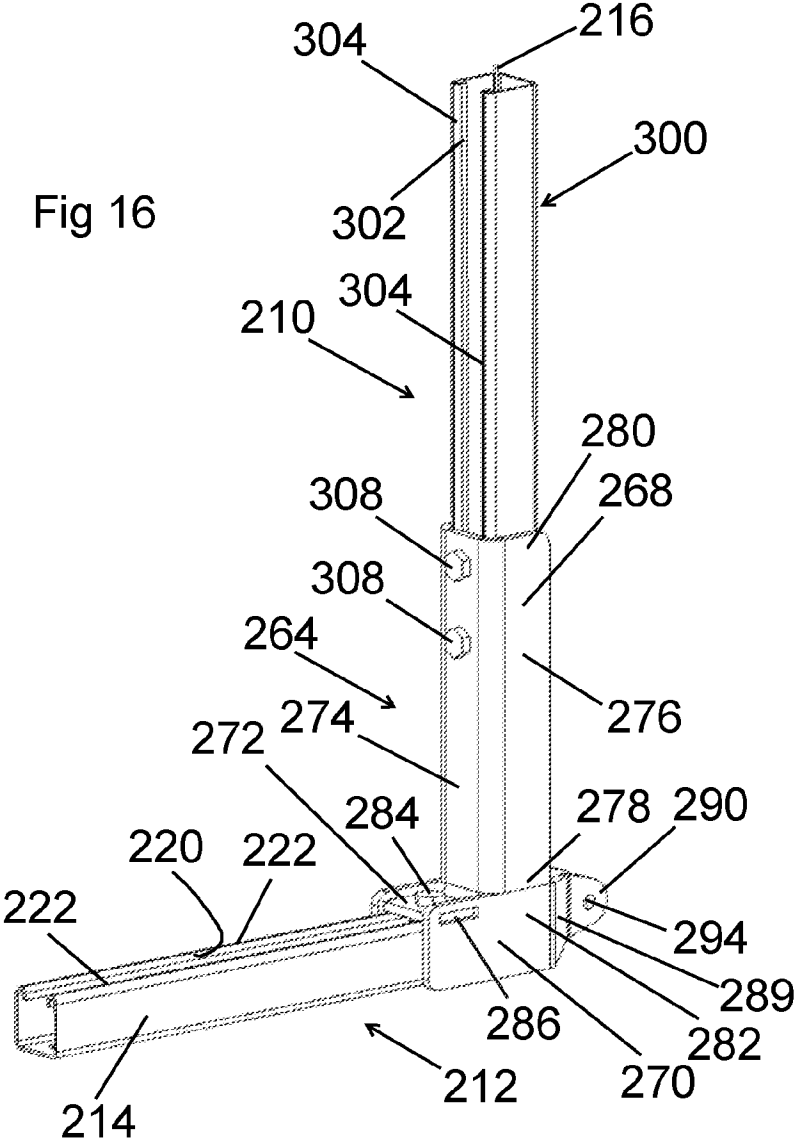
FIG. 16 is a perspective view from the first direction of the stiffening apparatus shown in FIGS. 11 and 12, in which an elongate extension member is depicted.

The holder 270 is elongate and comprises a pair of opposite substantially flat holding members 282. As shown in FIGS. 16 to 18, the holding members 282 receive the support article 214 therebetween.

A lower end region of the central member 274 is bent outwardly to extend between the holding members 282 and provide the securing element 272.

The securing element 272 secures the main part 264 to the support article 214 of the suspension assembly 212. The securing element 272 defines an aperture 273 through which a bolt 284 extends.

The securing element 272 has two opposite retaining formations 286, in the form of retaining lugs, to retain the securing element 272 on the holding members 282. The holding members 282 define corresponding apertures 288 to receive the retaining formations 286, thereby retaining the securing element 272 on the holder 270.

The stiffening apparatus 210 has a connector 287 to connect the main part 264 to a bracing assembly 292. The connector comprises a pair of tabs 289. The tabs 289 extend from the holder 270 in a second direction opposite to the first direction, i.e. in a rearward direction relative to the strut arrangement 268. The tabs 289 extend inwardly towards each other from the holder 270.

The connector 287 further includes a respective projection 290 on each of the tabs 289. The projections 290 are provided for connecting the main part 264 to a bracing assembly 292. The projections 290 extend from the tabs 289 in a rearward direction therefrom.

Figure 22:
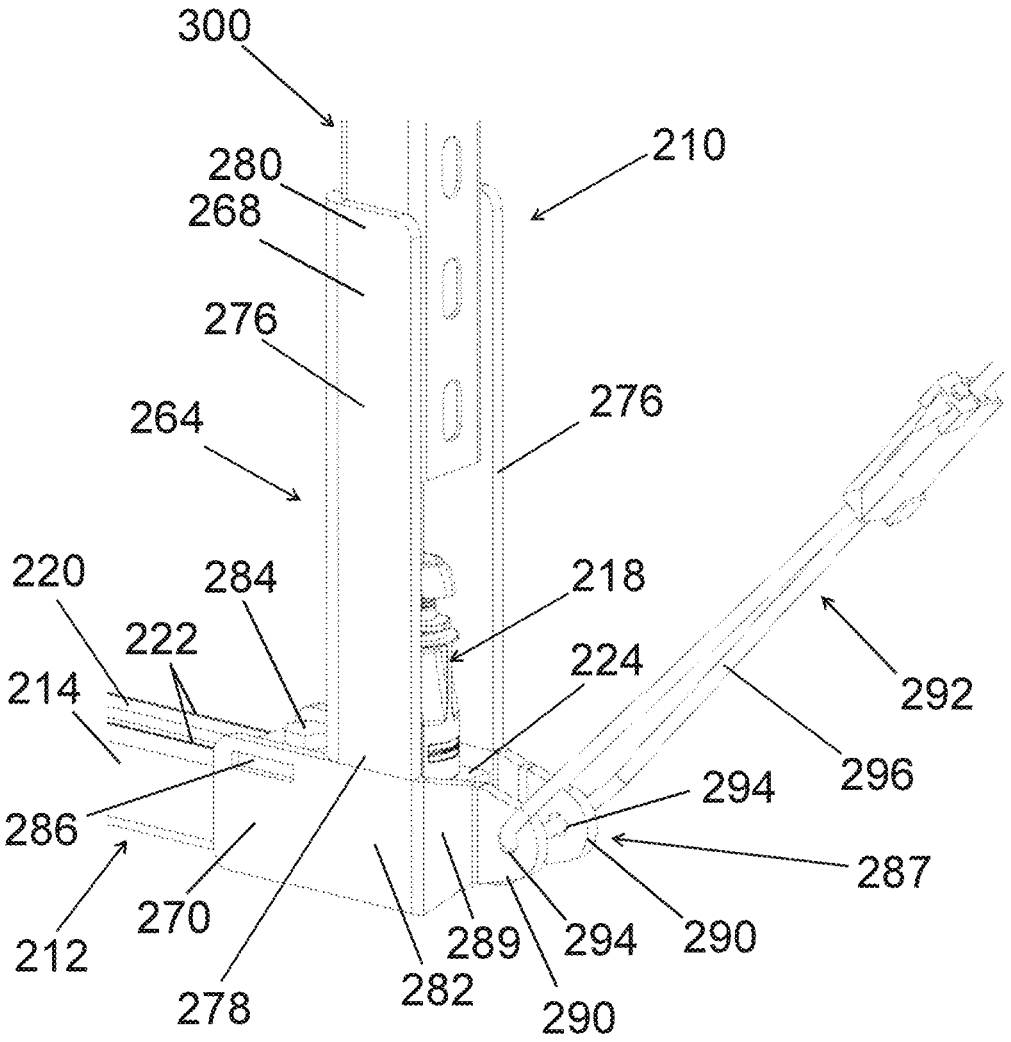
FIG. 22 is a close up view in which the stiffening apparatus shown in FIGS. 11 and 12 is connected to a bracing assembly.

Each projection 290 defines an aperture 294. As shown in FIG. 22, a cable 296 forming part of the bracing assembly 292 extends through the apertures 294 in the projections 290 to effect the connection of the main part 264 to the bracing assembly 292.

The bracing assembly 292 shown in FIG. 22 is a known bracing assembly 292 of which the skilled person would be aware. An upper end region (not shown in FIG. 22) of the bracing assembly 292 is secured to an upper support, such as the roof or ceiling to which the suspension assembly 212 is secured.

Referring to FIG. 15, the main part 264 is arranged in use over the suspension assembly 212 so that the support article 214 is received between the holding members 282 of the holder 270. When so arranged, the suspension article 216 is received by, and extends along, the strut arrangement 268.

The suspension article 216 extends through the open proximal and distal ends 278, 280 of the strut arrangement 268.

FIG. 15 further shows that the holding members 282 are arranged on either side of the support article 214, thereby holding the support article 214 therebetween. The securing element 272 extends across the open face 220 of the support article 214.

Figure 21:
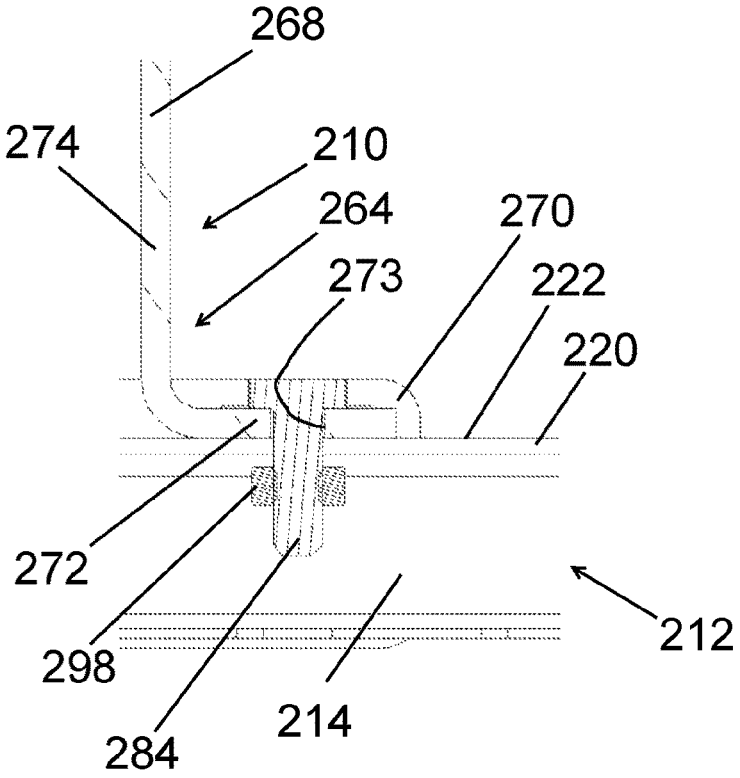
FIG. 21 is a close up view of the region marked XXI in FIG. 18.

Referring to FIGS. 18 and 21, the bolt 284 extends through the aperture 273 defined by the securing element 272. The main part 264 is moved along the support article 214 so that the tabs 289 are moved towards one end of the support article 214.

A channel nut 298 is provided to secure the securing element 272 to the support article 214, when the tabs 289 engage the end of the support article 214.

The channel nut 298 is provided within the support article 214, and the bolt 284 screwed into the channel nut 298, to tighten the channel nut 298 against the overhanging formations 222 of the support article 214. This secures the main part 264 to the support article 214.

When the main part 264 is secured to the support article 214, with the tabs 289 engaging the end of the support article 214, the strut arrangement 268 is positioned so that the suspension article 216 is received by the strut arrangement 268 as described above.

Referring to FIGS. 16, 17, 18 and 20, the stiffening apparatus 210 further includes an elongate extension member 300 for protecting the suspension article 216. The elongate extension member 300 has a channel configuration having an open face 302, and opposite overhanging formations 304 extending partially across the open face 302 of the extension member 300.

The extension member 300 is received in the strut arrangement 268 in an orientation in which the open face 302 of the extension member 300 faces inwardly of the strut arrangement 268, towards the central member 274. Thus, the suspension article 216 is received through the open face 302 into the extension member 300 when the strut arrangement 268 receives the extension member 300.

The extension member 300 extends upwardly from the strut arrangement 268. The length of the extension member 300 is selected so that the extension member 300 extends from the strut arrangement 268 and abuts against the roof support. Thus, the suspension article 216 is protected along the whole of its length by the extension member 300.

The central member 274 of the strut arrangement 268 defines two openings 306 through which fasteners 308 in the form of two bolts can be received to fasten the strut arrangement 268 to the extension member 300. Two channel nuts 310 are provided within the extension member 300.

The fasteners 308 extend through the openings 306 and are screwed into the channel nuts 310 to tighten the channel nuts 310 against the overhanging formations 304 of the extension member 300, thereby securing the extension member 300 to the strut arrangement 268.

There is thus described a stiffening apparatus 210 that, in the embodiment described herein, has the advantage that it can be easily mounted on a suspension assembly 212, either during installation of the suspension assembly 212, or afterwards. The stiffening apparatus 210 protects the suspension assembly 212 against seismic activity.

The above described embodiment of the stiffening apparatus 210 has the advantage that it can be installed at service level, which means that there is no need for the installer to move closer to the ceiling to fully strengthen the system, thereby reducing installation time, whilst avoiding difficulties associated with health and safety.

In addition, the embodiment of the stiffening apparatus 210 described herein, can be provided as a single unit, with all fastenings already attached. This saves labour time and is simpler compared to installing prior art apparatus comprising multiple separate components.

Furthermore, the stiffening apparatus 210 allows enough space for power tools to be used to tighten the securing features to the supporting elements.

Various modifications can be made without departing from the scope of the invention.

Figure 23:
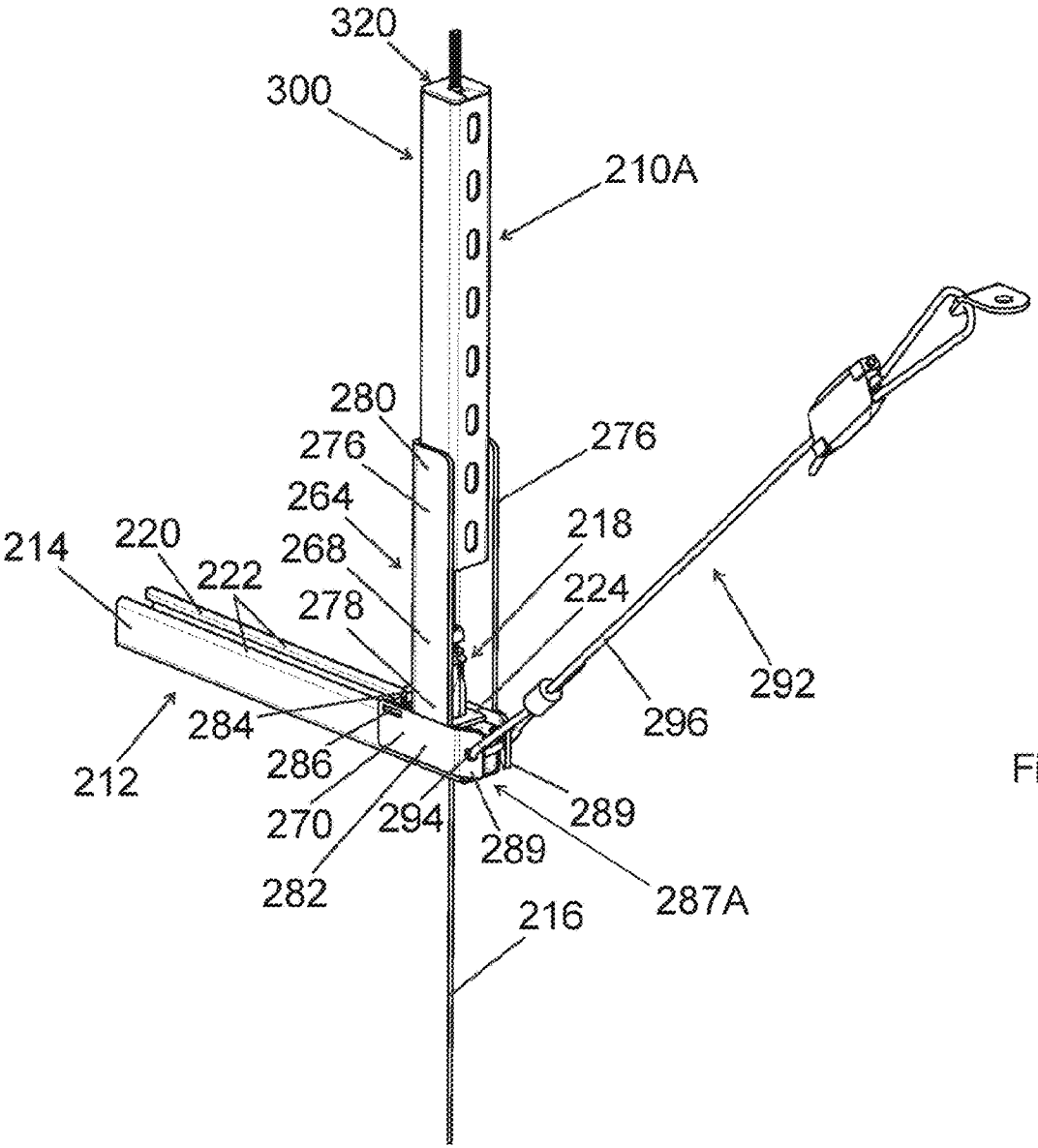
FIG. 23 is a perspective view of another version of the further stiffening apparatus connected to a bracing assembly.
Figure 24:
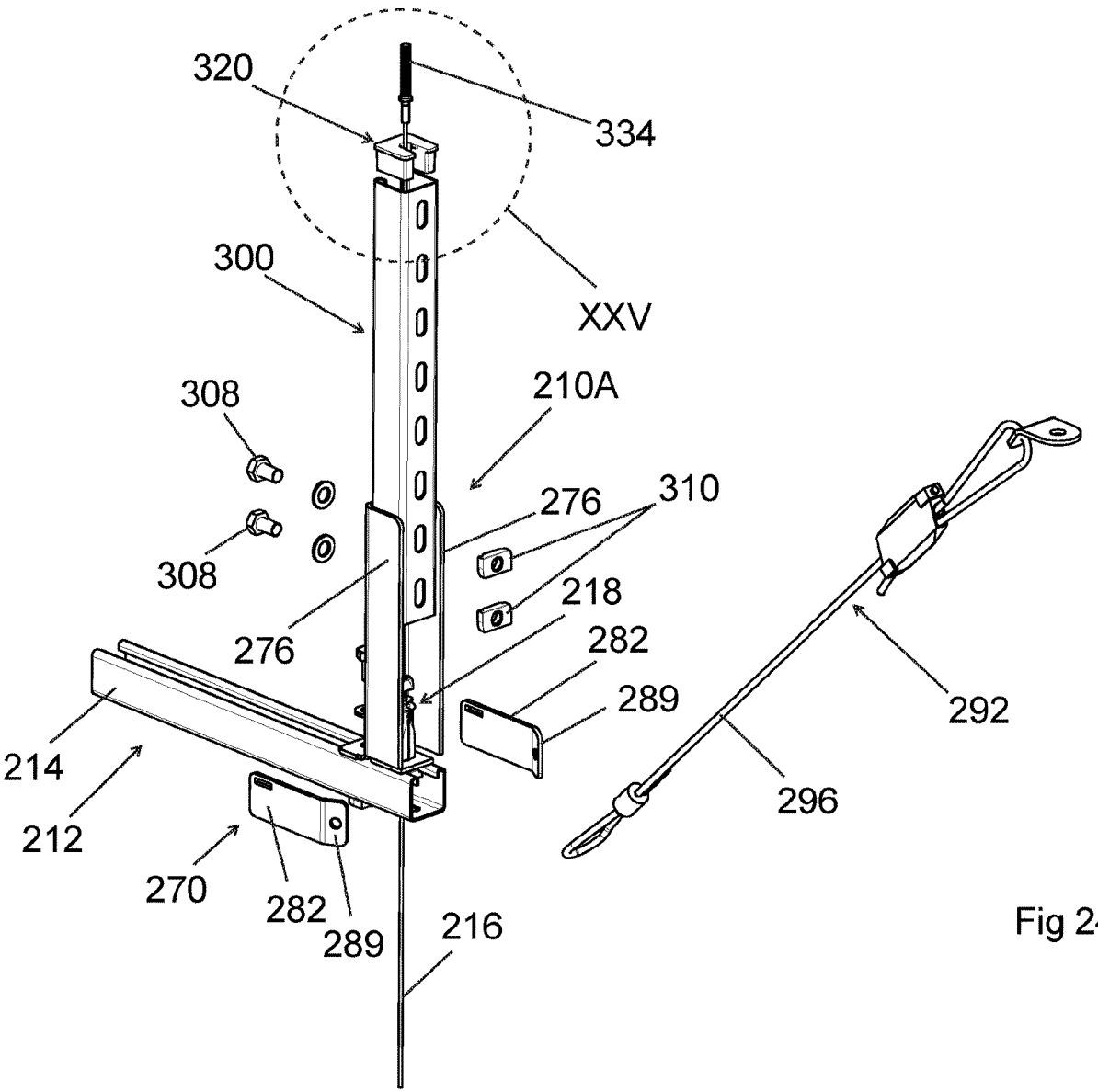
FIG. 24 is an exploded view of the stiffening apparatus and bracing assembly shown in FIG. 23.
Figure 25:
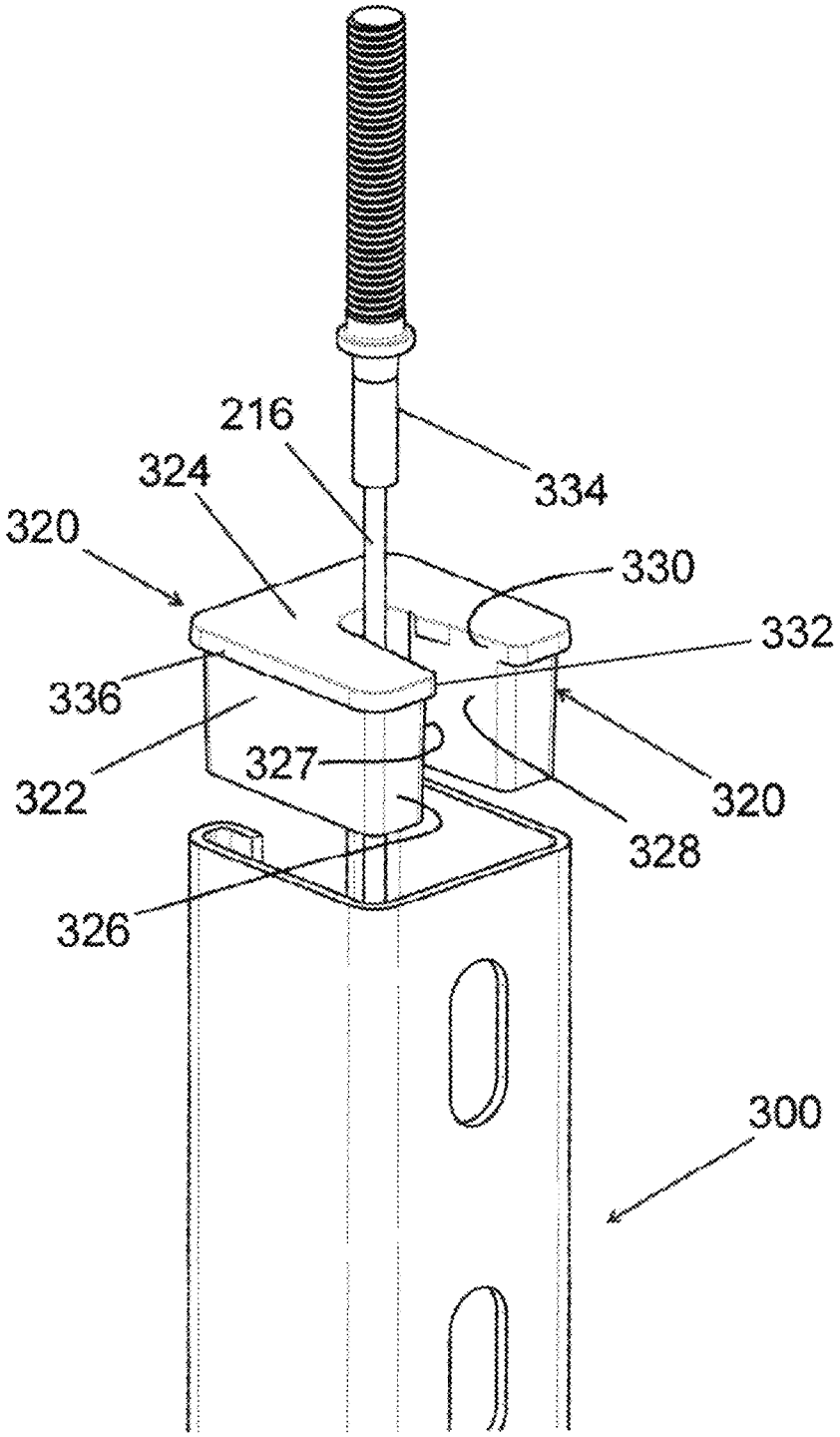
FIG. 25 is a close up view of the region marked XXV in FIG. 24.

A further embodiment of the stiffening apparatus 210A is shown in FIGS. 23 to 25. The stiffening apparatus 210A is the same as the stiffening apparatus 210 and comprises many of the same features as the stiffening apparatus 210. These features are designated with the same reference numerals in FIGS. 23 to 25 as the corresponding features in FIGS. 11 to 22.

The stiffening apparatus 210A differs from the stiffening apparatus 210 in that the connector 287 is replaced by a connector 287A, which comprises two of the tabs 289. The connector 287A is devoid of the projections 290. Instead, each of the apertures 294 is defined in a respective one of the tabs 289. Thus, the cable 296 of the bracing assembly 292 extends through the tabs 289 to connect the main part 264 to the bracing assembly 292, as shown in FIG. 23.

In another modification, the stiffening apparatus 210A includes an end cap 320 arrangeable in the top of the extension member 300. The end cap 320 is shown in detail in FIG. 25. The end cap 320 comprises an insert 322 and an upper cover 324. The insert 322 has a face 326 defining an opening 327. A space 328 extends from the opening 327.

The cover 324 defines a slot 330 having an open end 332. The open end 332 communicates with the opening 327, and the slot communicates with the space 328.

FIG. 25 also shows a fastener 334 on the upper end of the suspension article 216. The fastener 334 has a threaded portion which allows the fastener 334 to be attached to the roof or ceiling.

The end cap 320 is depicted in use with the stiffening apparatus 210A shown in FIGS. 23 to 25. It will be appreciated that the end cap 320 could be used with the stiffening apparatus 210 shown in FIGS. 11 to 22.

The insert 322 is received in the top end of the extension member 300, thereby mounting the end cap 320 on the extension member 300. The cover 324 has a flange 336 extending around the edge of the cover 324. The flange 336 overhangs the insert 322, and engages the top edge of the extension member 300 when the end cap 320 is mounted on the extension member 300.

In order to mount the end cap 320 on the top end of the extension member 300, the suspension article 216 is received in the slot 330, passing through the face 326 and the open end 332. When so received, the end cap 320 is slid down the suspension article 216 until the end cap 320 is mounted on the top end of the extension member 300. It is desirable if the end cap 320 is positioned so that the opening defined by the face 326 faces away from the open face 302 of the extension member 300.

When the end cap 320 is mounted on the top end of the extension member 300, the suspension article 216 is held within the slot 328. This provides the advantage that the suspension article is maintained by the end cap 320 centrally within the extension member 300.

The invention claimed is:

1. A stiffening apparatus for use with a suspension assembly, the stiffening apparatus comprising: an elongate strut arrangement having a main axis, whereby the strut arrangement is configured for receiving a first part of the suspension assembly lengthwise along, or parallel to, the main axis; a holder extending from the strut arrangement in a direction transverse thereto, the holder being configured for receiving a second part of the suspension assembly, and the holder being for securing the stiffening apparatus to the suspension assembly; and a connector for connecting the stiffening apparatus to a bracing assembly; wherein the connector extends in a direction opposite to the direction in which the holder extends from the strut arrangement, wherein the strut arrangement comprises a channel component, said channel component comprising a central member, and lateral members extending from the central member, wherein the strut arrangement comprises an elongate extension member receivable by the channel component, the extension member being fastenable to the channel component, wherein the extension member comprises a channel having an open face, and the extension member has a substantially U shaped end profile, wherein the extension member has opposite return formations extending partially across the open face of the extension member, the open face of the extension member allowing the suspension article to be received in the extension member.

2. The stiffening apparatus according to claim 1, wherein the stiffening apparatus comprises a main part, the main part comprising the strut arrangement and the holder, and wherein the main part is substantially L shaped, whereby the holder extends from the strut arrangement in said direction to provide the L shape.

3. The stiffening apparatus according to claim 2, wherein the strut arrangement has opposite edges, said opposite edges of the strut arrangement defining an open face of the strut arrangement, the open face of the strut arrangement allowing a further part of the suspension assembly to be received in the strut arrangement, said open face of the strut arrangement facing in the direction in which the holder extends from the strut arrangement.

4. The stiffening apparatus according to claim 1, wherein the holder comprises a pair of substantially flat members extending parallel to each other, the substantially flat members defining therebetween an open face of the holder, the substantially flat members defining holes for receiving securing elements therethrough to secure the holder to the suspension assembly.

5. The stiffening apparatus according to claim 4, wherein the substantially flat members have respective opposite edges, said opposite edges of the substantially flat members defining the aforesaid open face of the holder.

6. The stiffening apparatus according to claim 4, wherein the open face of the holder is arranged adjacent the open face of the strut arrangement, and the opposite edges of the holder extending from the opposite edges of the strut arrangement.

7. The stiffening apparatus according to claim 4, wherein the substantially flat members have respective further opposite edges to define therebetween a further open face of the holder, said further open face of the holder being arranged opposite the first mentioned open face of the holder.

8. The stiffening apparatus according to claim 7, wherein the holder has a locating formation to locate stiffening apparatus relative to the suspension assembly, the locating formation extending at least partially across the further open face of the holder.

9. The stiffening apparatus according to claim 8, wherein the holder has a pair of the locating formations, each locating formation extending from a respective one of the further opposite edges.

10. The stiffening apparatus according to claim 1, wherein the strut arrangement has opposite proximal and distal ends defining respective openings, to allow the suspension article to extend through the openings in the strut arrangement, the holder being provided at the proximal end of the strut arrangement.

11. The stiffening apparatus according to claim 1, wherein the connector defines an aperture for receipt of some of the bracing assembly therethrough.

12. The stiffening apparatus according to claim 1, wherein the extension member is receivable by the strut arrangement lengthwise along the strut arrangement.

13. The stiffening apparatus according to claim 1, wherein the extension member extends upwardly from the strut arrangement, the length of the extension member being such that the extension member extends from the strut arrangement to the roof support.

14. The stiffening apparatus according to claim 1, wherein an obstructor is secured to the extension member, the obstructor extending across the open face of the extension member.

15. The stiffening apparatus according to claim 14, wherein the obstructor comprises a first and second further fasteners, the first further fastener being received within the channel of the elongate extension member to engage the return formations within the channel.

16. A stiffening apparatus for use with a suspension assembly, the stiffening apparatus comprising: a strut arrangement configured for receiving a first part of the suspension assembly; a holder extending from the strut arrangement in a direction transverse thereto, the holder being configured for receiving a second part of the suspension assembly, and the holder being configured for securing the stiffening apparatus to the suspension assembly; a bracing assembly and a connector for connecting the stiffening apparatus to the bracing assembly; wherein the connector and the bracing assembly extend in a direction opposite to the direction in which the holder extends from the strut arrangement, wherein the strut arrangement comprises a channel component, said channel component comprising a central member, and lateral members extending from the central member, wherein the strut arrangement comprises an elongate extension member receivable by the channel component, the extension member being fastenable to the channel component, wherein the extension member comprises a channel having an open face, and the extension member has a substantially U shaped end profile, wherein the extension member has opposite return formations extending partially across the open face of the extension member, the open face of the extension member allowing the suspension article to be received in the extension member.

17. An arrangement comprising a stiffening apparatus and a suspension assembly, the suspension assembly comprising first and second parts; wherein the stiffening apparatus comprises: a strut arrangement configured for receiving the first part of the suspension assembly; a holder extending from the strut arrangement in a direction transverse thereto, the holder being configured for receiving the second part of the suspension assembly, and the holder being for securing the stiffening apparatus to the suspension assembly; a bracing assembly and a connector for connecting the stiffening apparatus to the bracing assembly; wherein the connector extends in a direction opposite to the direction in which the holder extends from the strut arrangement, wherein the strut arrangement comprises a channel component, said channel component comprising a central member, and lateral members extending from the central member, wherein the strut arrangement comprises an elongate extension member receivable by the channel component, the extension member being fastenable to the channel component, wherein the extension member comprises a channel having an open face, and the extension member has a substantially U shaped end profile, wherein the extension member has opposite return formations extending partially across the open face of the extension member, the open face of the extension member allowing the suspension article to be received in the extension member.

* * * * *